US010559286B2

(12) United States Patent
Tamaki et al.

(10) Patent No.: US 10,559,286 B2
(45) Date of Patent: Feb. 11, 2020

(54) DISPLAY DEVICE

(71) Applicant: Japan Display Inc., Tokyo (JP)

(72) Inventors: Masaya Tamaki, Tokyo (JP); Yutaka Mitsuzawa, Tokyo (JP); Takayuki Nakao, Tokyo (JP); Yutaka Ozawa, Tokyo (JP)

(73) Assignee: Japan Display Inc., Tokyo (JP)

( * ) Notice: Subject to any disclaimer, the term of this patent is extended or adjusted under 35 U.S.C. 154(b) by 0 days.

(21) Appl. No.: 16/057,934

(22) Filed: Aug. 8, 2018

(65) Prior Publication Data

US 2019/0066634 A1 Feb. 28, 2019

(30) Foreign Application Priority Data

Aug. 22, 2017 (JP) ..... 2017-159384

(51) Int. Cl.
*G09G 5/395* (2006.01)
*G09G 3/36* (2006.01)

(52) U.S. Cl.
CPC ..... *G09G 5/395* (2013.01); *G09G 3/3607* (2013.01); *G09G 3/3674* (2013.01); *G09G 3/3685* (2013.01); *G09G 2330/021* (2013.01)

(58) Field of Classification Search
None
See application file for complete search history.

(56) References Cited

U.S. PATENT DOCUMENTS 5,945,972 A * 8/1999 Okumura ..... G09G 3/3648 345/100
2002/0021274 A1* 2/2002 Koyama ..... G09G 3/3266 345/98
2002/0089496 A1* 7/2002 Numao ..... G09G 3/3258 345/204
2002/0093472 A1* 7/2002 Numao ..... G09G 3/3258 345/87
2004/0196235 A1* 10/2004 Koyama ..... G09G 3/3607 345/89

(Continued)

FOREIGN PATENT DOCUMENTS

JP H09-212140 A 8/1997

*Primary Examiner* — Kent W Chang
*Assistant Examiner* — Nathaniel P Brittingham
(74) *Attorney, Agent, or Firm* — K&L Gates LLP

(57) ABSTRACT

A display device includes: sub-pixels each including a memory block including memories; memory selection line groups each including memory selection lines electrically coupled to the memory blocks in the sub-pixels that belong to the corresponding row; a memory selection circuit configured to concurrently output memory selection signals to the memory selection line groups; a potential line; a conduction switch provided for at least one memory in the memory block on a one-to-one basis; and an operating-memory conduction circuit configured to output, to the conduction switch, an operation signal for determining whether to electrically couple or uncouple the potential line and the corresponding one memory. Each memory is capable of storing sub-pixel data therein when being coupled to the potential line. Each sub-pixel displays an image based on the sub-pixel data stored in one memory in the sub-pixel according to the memory selection line supplied with the memory selection signal.

8 Claims, 12 Drawing Sheets

(56) References Cited

U.S. PATENT DOCUMENTS

| | | | | |
|---|---|---|---|---|
| 2005/0157539 | A1* | 7/2005 | Van Der Zaag | G11C 11/16 365/158 |
| 2005/0230723 | A1* | 10/2005 | Van Der Zaag | G09G 3/20 257/295 |
| 2009/0102751 | A1* | 4/2009 | Takatoku | G09G 3/3659 345/55 |
| 2009/0141013 | A1* | 6/2009 | Nagai | G09G 3/3659 345/211 |
| 2011/0069075 | A1* | 3/2011 | Nurmi | G09G 3/3648 345/545 |
| 2012/0019436 | A1* | 1/2012 | Yamashita | G09G 3/3225 345/76 |
| 2012/0099038 | A1* | 4/2012 | Yoshiga | G02F 1/133371 349/33 |
| 2012/0188166 | A1* | 7/2012 | Nurmi | G09G 3/3648 345/168 |
| 2013/0002626 | A1* | 1/2013 | Washio | G09G 3/2085 345/205 |
| 2014/0015866 | A1* | 1/2014 | Teranishi | G09G 3/2007 345/690 |
| 2014/0340383 | A1* | 11/2014 | Gyouten | G09G 3/3696 345/212 |
| 2016/0372054 | A1* | 12/2016 | Yamazaki | G09G 3/344 |
| 2017/0187976 | A1* | 6/2017 | Cok | H04N 5/376 |
| 2017/0200407 | A1* | 7/2017 | Nakao | G09G 3/2003 |
| 2018/0075823 | A1* | 3/2018 | Nakao | G09G 3/3677 |
| 2018/0191978 | A1* | 7/2018 | Cok | G09G 3/3208 |
| 2018/0211615 | A1* | 7/2018 | Tan | G02F 1/13306 |
| 2019/0005904 | A1* | 1/2019 | Mitsuzawa | G09G 3/3614 |
| 2019/0066634 | A1* | 2/2019 | Tamaki | G09G 5/395 |
| 2019/0114983 | A1* | 4/2019 | Mitsui | G09G 3/3677 |
| 2019/0197996 | A1* | 6/2019 | Mitsuzawa | G09G 5/399 |

* cited by examiner

DISPLAY DEVICE

CROSS-REFERENCE TO RELATED APPLICATIONS

This application claims priority from Japanese Application No. 2017-159384, filed on Aug. 22, 2017, the contents of which are incorporated by reference herein in its entirety.

BACKGROUND

1. Technical Field

The present invention relates to a display device.

2. Description of the Related Art

A display device, which displays images, includes a plurality of pixels. Japanese Patent Application Laid-open Publication No. 9-212140 (JP-A-9-212140) discloses what is called a memory-in-pixel (MIP) type display device in which each pixel includes a memory. In the display device disclosed in JP-A-9-212140, each of the pixels includes a plurality of memories and a circuit that switches the memories from one to another.

In the display device disclosed in JP-A-9-212140, the memories in each pixel is kept operating in an image information storable state. Therefore, regardless of whether memories are being switched, the display device disclosed in JP-A-9-212140 consumes power for causing the memories to operate. That is, the display device in JP-A-9-212140 cannot reduce power consumption for causing memories not in use to operate even while the memories are not being switched.

For the foregoing reasons, there is a need for a display device capable of reducing power consumption.

SUMMARY

According to an aspect, a display device includes: a plurality of sub-pixels arranged in a row direction and a column direction and each including a memory block that includes a plurality of memories each of which configured to store therein sub-pixel data; a plurality of memory selection line groups provided corresponding to a plurality of rows and each including a plurality of memory selection lines electrically coupled to the memory blocks in the sub-pixels that belong to the corresponding row; a memory selection circuit configured to concurrently output memory selection signals to the memory selection line groups, the memory selection signals each being a signal for selecting one from the memories in the corresponding memory block; a potential line having a potential for operating the memories applied thereto; a conduction switch provided for at least one of the memories in the memory block on a one-to-one basis and configured to switch between electrically coupling and electrically uncoupling the potential line and a corresponding one memory; and an operating-memory conduction circuit configured to output, to the conduction switch, an operation signal for determining whether to electrically couple or uncouple the potential line and the corresponding one memory. Each of the memories is capable of storing sub-pixel data therein when being coupled to the potential line. Each of the sub-pixels displays an image based on the sub-pixel data stored in one of the memories in the sub-pixel in accordance with the memory selection line that has been supplied with the memory selection signal.

DETAILED DESCRIPTION

Figure 1:
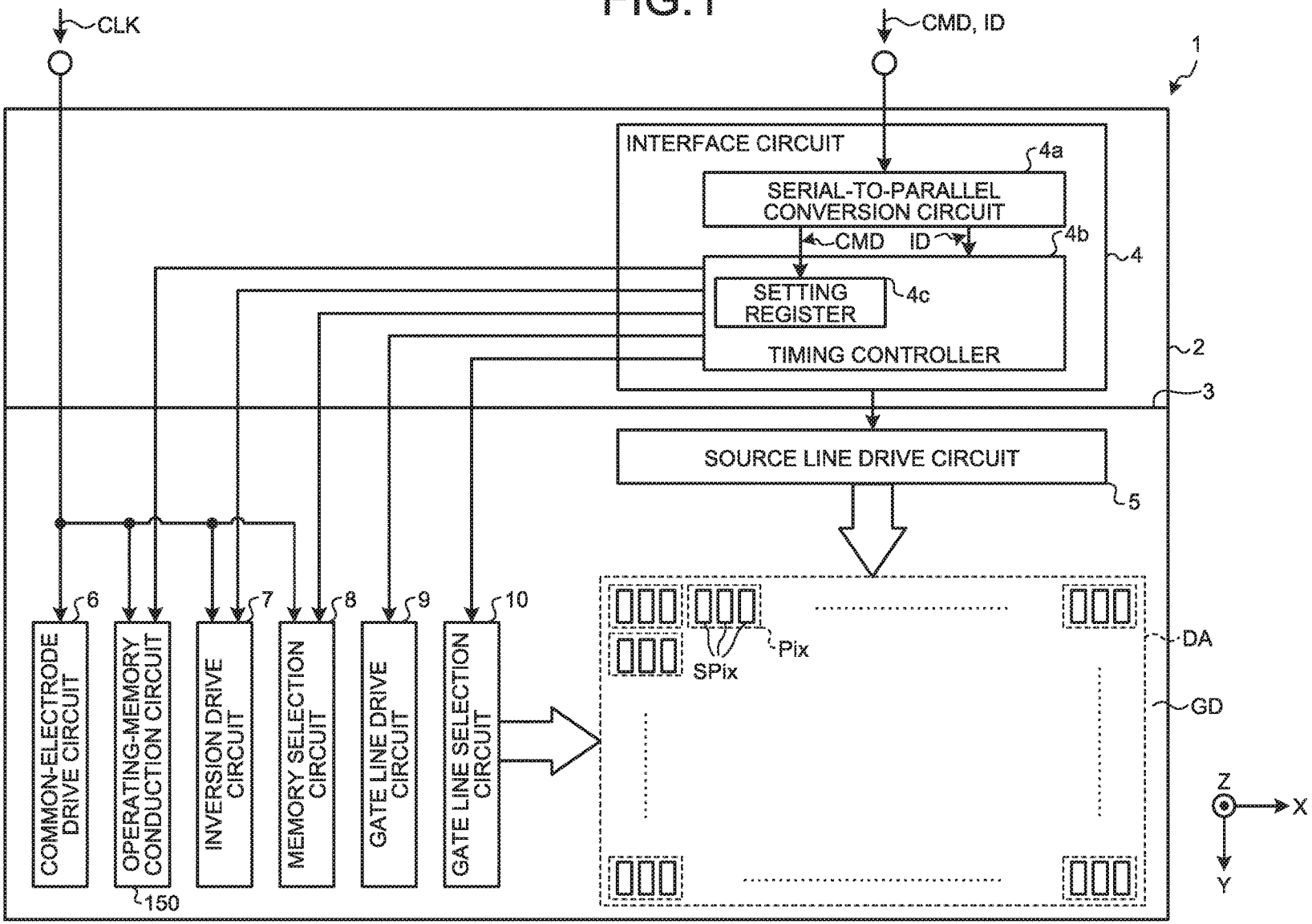
FIG. 1 schematically illustrates an entire configuration of a display device in an embodiment.

Modes (embodiments) for carrying out the present invention are described hereinbelow in detail with reference to the drawings. Descriptions of the following embodiments are not intended to limit the present invention. The constituent elements described below include those readily apparent to the skilled person or substantially the same. Any two or more of the constituent elements described below can be combined as appropriate. What is disclosed herein is merely exemplary, and modifications made without departing from the spirit of the invention and readily apparent to the skilled person naturally fall within the scope of the present invention. The widths, the thicknesses, the shapes, or the like of certain devices in the drawings may be illustrated not-to-scale, for illustrative clarity. However, the drawings are merely exemplary and not intended to limit interpretation of the present invention. Throughout the description and the drawings, the same elements as those already described with reference to the drawing already referred to are assigned the same reference signs, and detailed descriptions thereof are omitted as appropriate.

In this disclosure, when an element is described as being "on" another element, the element can be directly on the other element, or there can be one or more elements between the element and the other element.

1. EMBODIMENT

1-1. Entire Configuration

FIG. 1 schematically illustrates an entire configuration of a display device 1 in an embodiment. The display device 1 includes a first panel 2 and a second panel 3 disposed facing the first panel 2. The display device 1 has a display region DA on which images are displayed, and a frame region GD outside of the display region DA. In the display region DA, a liquid crystal layer is sealed between the first panel 2 and the second panel 3.

While the display device 1 is described as a liquid crystal display device including a liquid crystal layer in the embodiment, this disclosure is not limited to this example. The display device 1 may be an organic electro-luminescence (EL) display device including organic EL elements in place of a liquid crystal layer.

In the display region DA, a plurality of pixels Pix are disposed in a matrix of N columns (where N is a natural number) and M rows (where M is a natural number). The N columns are arranged in the X direction parallel to the respective principal planes of the first panel 2 and the second panel 3, and the M rows are arranged in the Y direction, which is parallel to the respective principal planes of the first panel 2 and the second panel 3 and intersects the X direction. In the frame region GD, an interface circuit 4, a source line drive circuit 5, a common-electrode drive circuit 6, an inversion drive circuit 7, a memory selection circuit 8, a gate line drive circuit 9, a gate line selection circuit 10, and an operating-memory conduction circuit 150 are disposed. Another configuration can be employed in which, while the interface circuit 4, the source line drive circuit 5, the common-electrode drive circuit 6, the inversion drive circuit 7, the memory selection circuit 8 of the foregoing circuits are integrated into an integrated circuit (IC) chip, the gate line drive circuit 9, the gate line selection circuit 10, and the operating-memory conduction circuit 150 are provided on the first panel 2. Still another configuration can be employed in which a group of such circuits integrated into an IC chip is provided in a processor external to a display device and is coupled to the display device.

Each of the M×N pixels Pix has a plurality of sub-pixels SPix. While these sub-pixels SPix are described as three pixels of R (red), G (green), and B (blue) in the embodiment, this disclosure is not limited to this example. These sub-pixels SPix may be four sub-pixels of colors including W (white) in addition to R (red), G (green), and B (blue). Alternatively, these sub-pixels SPix may be five or more sub-pixels of different colors.

In the embodiment, these sub-pixels SPix are three sub-pixels, and the total number of sub-pixels SPix disposed in the display region DA is accordingly M×N×3. In the embodiment, three sub-pixels SPix in each of the M×N pixels Pix are arranged in the X direction, and the total number of sub-pixels SPix disposed in any one of the rows included in the M×N pixels Pix is accordingly N×3.

Each of the sub-pixels SPix includes a plurality of memories. While these memories are described as three memories that are a first memory to a third memory in this embodiment, this disclosure is not limited to this example. These memories may be two memories or may be four or more memories.

In the embodiment, these memories are three memories, and the total number of memories disposed in the display region DA is accordingly M×N×3×3. In the embodiment, each of the sub-pixels SPix includes three memories, and the total number of memories disposed in any one of the rows included in the M×N pixels Pix is accordingly N×3×3.

Each of the sub-pixels SPix performs display based on sub-pixel data stored in one memory selected from the first memory, the second memory, and the third memory included in the sub-pixel SPix. That is, a set of M×N×3×3 memories included in the M×N×3 sub-pixels SPix is equivalent to three frame memories.

The interface circuit 4 includes a serial-to-parallel conversion circuit 4*a* and a timing controller 4*b*. The timing controller 4*b* includes a setting register 4*c*. The serial-to-parallel conversion circuit 4*a* is supplied with command data CMD and image data ID in a serial form from an external circuit. While the external circuit is exemplified by a host central processing unit (CPU) or an application processor, this disclosure is not limited to these examples.

The serial-to-parallel conversion circuit 4*a* converts the command data CMD supplied thereto into data in a parallel form and outputs the converted data to the setting register 4*c*. The setting register 4*c* has values therein set based on the command data CMD. The values are used for controlling the source line drive circuit 5, the inversion drive circuit 7, the memory selection circuit 8, the gate line drive circuit 9, the gate line selection circuit 10, and the operating-memory conduction circuit 150.

The serial-to-parallel conversion circuit 4*a* converts the image data ID supplied thereto into data in a parallel form and outputs the converted data to the timing controller 4*b*. Based on the values that are set in the setting register 4*c*, the timing controller 4*b* outputs the image data ID to the source line drive circuit 5. Based on the values that are set in the setting register 4*c*, the timing controller 4*b* controls the inversion drive circuit 7, the memory selection circuit 8, the gate line drive circuit 9, the gate line selection circuit 10, and the operating-memory conduction circuit 150.

The common-electrode drive circuit 6, the inversion drive circuit 7, and the memory selection circuit 8 are supplied with a reference clock signal CLK from an external circuit. While the external circuit is exemplified by a clock generator, this disclosure is not limited to this example.

It is well known that there are methods for preventing image burn-in on a screen of a liquid crystal display device, the methods including a common inversion driving method, a column inversion driving method, a line inversion driving method, a dot inversion driving method, and a frame inversion driving method.

The display device 1 can employ any one of the driving methods listed above. In the embodiment, the display device 1 employs a common inversion driving method. In the display device 1 that employs a common inversion driving method, the common-electrode drive circuit 6 inverts the potential (common potential) of a common electrode in synchronization with the reference clock signal CLK. Under the control of the timing controller 4*b*, the inversion drive circuit 7 inverts the potentials of sub-pixel electrodes in synchronization with the reference clock signal CLK. Thus, the display device 1 can implement a common inversion driving method. In the embodiment, the display device 1 is a normally-black liquid crystal display device that displays black when no voltage is applied to the liquid crystal and displays white when a voltage is applied to the liquid crystal. A normally-black liquid crystal display device displays black when the potential of the sub-pixel electrode and the common potential are in phase with each other, and displays white when the potential of the sub-pixel electrode and the common potential are not in phase with each other.

The reference clock signal CLK is an example of a referential signal.

In order to display an image on the display device, it is necessary to have the sub-pixel data stored in the first to third memories in each of the sub-pixels SPix. Under the control of the timing controller 4*b*, the gate line drive circuit 9 outputs a gate signal for selecting one of the rows included in the M×N pixels Pix so that the sub-pixel data can be stored in these individual memories.

In an MIP-type liquid crystal display device in which each sub-pixel includes one memory, one gate line is disposed for each row (pixel row (sub-pixel row)). In the embodiment, however, each of the sub-pixels SPix includes three memories that are the first memory to the third memory. For this reason, three gate lines are disposed for each row in the embodiment. The respective three gate lines are electrically coupled to the first memory to the third memory in each of the sub-pixels SPix included in the one row. In a configuration such that each of the sub-pixels SPix is configured to operate in accordance with a gate signal and an inverted gate signal obtained by inverting the gate signal, six gate lines are disposed for each row.

The three or six gate lines disposed for each row correspond to a gate line group. In the embodiment, the display device 1 includes M rows of pixels Pix, and M gate line groups are accordingly disposed.

The gate line drive circuit 9 includes M output terminals corresponding to the M rows of pixels Pix. Under the control of the timing controller 4*b*, the gate line drive circuit 9 sequentially outputs, from the M output terminals, the gate signal serving as a signal for selecting one of the M rows.

Under the control of the timing controller 4*b*, the gate line selection circuit 10 selects one of the three gate lines disposed for each row. Thus, the gate signal output from the gate line drive circuit 9 is supplied to the selected one of the three gate lines disposed for the row.

Under the control of the timing controller 4*b*, the operating-memory conduction circuit 150 turns on the supply of electric power to a memory in which sub-pixel data is stored, among the memories (the first, second memories, and third memories) included in each of the sub-pixels SPix. Thus, the memories to which power is supplied are caused to operate, thus turning into a state in which sub-pixel data can be stored therein.

Under the control of the timing controller 4*b*, the source line drive circuit 5 outputs the sub-pixel data to memories selected in accordance with the gate signal. Thus, the corresponding sub-pixel data is sequentially stored in the first memory to the third memory in each of the sub-pixels. Sub-pixel data is stored in one of the memories (the first memory, the second memory, the third memory) that is currently operating.

The display device 1 performs line sequential scanning on the M rows of pixels Pix to store the sub-pixel data as frame data for one frame in the first memories in the sub-pixels SPix. The display device 1 performs the line sequential scanning three times to store the frame data for three frames in the first memory to the third memory in each of the sub-pixels SPix.

For the same effect, the display device 1 can alternatively employs another procedure in which corresponding data are written into the first memories, into the second memories, and into the third memories when each of the rows is scanned. When this scanning is performed on the individual first to M-th columns, the sub-pixel data in the first memories to the third memories in the respective sub-pixels SPix can be stored through line sequential scanning performed only one time.

In the embodiment, three memory selection lines are disposed for each row. The three memory selection lines are electrically coupled to the first to third memories, respectively, in each of N×3 sub-pixels SPix included in the one row. In a configuration such that each of the sub-pixels SPix is configured to operate in accordance with a memory selection signal and an inverted memory selection signal obtained by inverting the memory selection signal, six memory selection lines are disposed for each row.

The three or six memory selection lines disposed for each row correspond to a memory selection line group. In the embodiment, the display device 1 includes the pixels Pix disposed in M rows, and M memory selection line groups are accordingly disposed.

Under the control of the timing controller 4*b*, the memory selection circuit 8 concurrently selects the first memories, the second memories, or the third memories in the respective sub-pixels SPix in synchronization with the reference clock signal CLK. More specifically, the first memories in all of the sub-pixels SPix are concurrently selected. Otherwise, the second memories in all of the sub-pixels SPix are concurrently selected. The third memories in all of the sub-pixels SPix are concurrently selected. Consequently, the display device 1 can display one among three images by switching selection of a memory from one to another among the first memory to the third memory in each of the sub-pixels SPix. Thus, the display device 1 can change images all together and can quickly change images. The display device 1 enables animation display (moving image display) by sequentially switching selection of a memory from one to another among the first memory to the third memory in each of the sub-pixels SPix.

1-2. Sectional Structure

Figure 2:
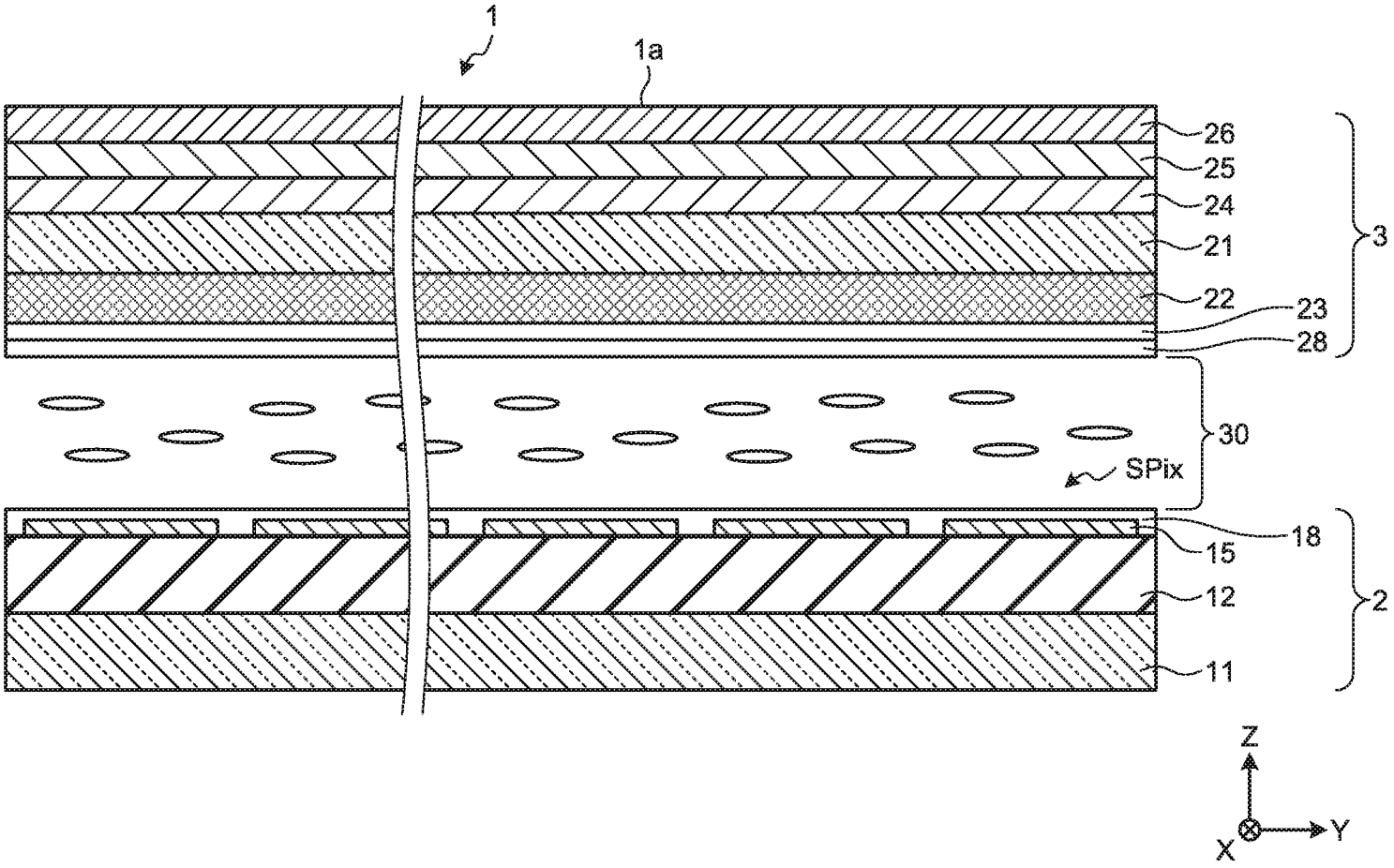
FIG. 2 is a schematic diagram of a sectional structure of the display device in the embodiment.

FIG. 2 is a schematic diagram of a sectional structure of the display device 1 in the embodiment. As illustrated in FIG. 2, the display device 1 includes the first panel 2, the second panel 3, and a liquid crystal layer 30. The second panel 3 is disposed facing the first panel 2. The liquid crystal layer 30 is interposed between the first panel 2 and the second panel 3. One surface of the second panel 3 that constitutes the principal plane thereof is a display surface 1*a* for displaying an image thereon.

Light incident on the display surface 1*a* from the outside thereof is reflected by reflective electrodes 15 in the first panel 2 and exits from the display surface 1*a*. The display device 1 in the embodiment is a reflective liquid crystal display device that displays an image on the display surface 1*a* using this reflected light. In the present description, one direction parallel to the display surface 1*a* is set as the X direction, and a direction extending on a plane parallel to the display surface 1*a* and intersecting the X direction is set as the Y direction. A direction perpendicular to the display surface 1*a* is set as the Z direction.

The first panel 2 includes a first substrate 11, an insulating layer 12, the reflective electrodes 15, and an orientation film 18. The first substrate 11 is exemplified by a glass substrate or a resin substrate. On a surface of the first substrate 11, circuit elements and wiring of various kinds such as gate lines and data lines are mounted, which are not illustrated. Switching elements such as thin film transistors (TFTs) and capacitive elements are included in the circuit elements.

The insulating layer 12 is disposed on the first substrate 11, and serves to provide a flush surface all over the surfaces of the circuit elements and the wiring of various kinds. The plurality of reflective electrodes 15 are disposed on the insulating layers 12. The orientation film 18 is interposed between the reflective electrodes 15 and the liquid crystal layer 30. The reflective electrodes 15 each having a rectangular shape are provided corresponding to the sub-pixels SPix. The reflective electrodes 15 are formed of metal exemplified by aluminum (Al) or silver (Ag). The reflective electrodes 15 may have a configuration stacked with such a metal material and a translucent conductive material exemplified by indium tin oxide (ITO). The reflective electrodes 15 are formed of a material having favorable reflectance, thereby functioning as a reflective plate that reflects light incident from the outside.

After being reflected by the reflective electrodes 15, the light travels in a uniform direction toward the display surface 1*a* although being diffusely reflected and scattered. Change in level of voltage applied to each of the reflective electrodes 15 causes change in the state of light transmission through the liquid crystal layer 30 on that reflective electrode, that is, the state of light transmission of the corresponding sub-pixel. In other words, the respective reflective electrodes 15 also function as sub-pixel electrodes.

The second panel 3 includes a second substrate 21, a color filter 22, a common electrode 23, an orientation film 28, a quarter wavelength plate 24, a half wavelength plate 25, and a polarization plate 26. The color filter 22 and the common electrode 23 are disposed in this order on one of the two opposite surfaces of the second substrate 21, the one surface facing the first panel 2. The orientation film 28 is interposed between the common electrode 23 and the liquid crystal layer 30. The quarter wavelength plate 24, the half wavelength plate 25, and the polarization plate 26 are stacked in this order on a surface of the second substrate 21, the surface facing the display surface 1*a*.

The second substrate 21 is exemplified by a glass substrate or a resin substrate. The common electrode 23 is formed of a translucent conductive material exemplified by ITO. The common electrode 23 is disposed facing the reflective electrodes 15 and supplies a common potential to the sub-pixels SPix. While the color filter 22 is exemplified as including filters for three colors of R (red), G (green), and B (blue), this disclosure is not limited to this example.

The liquid crystal layer 30 is exemplified as containing nematic liquid crystal. In the liquid crystal layer 30, how liquid crystal molecules are oriented is changed when the voltage level between the common electrode 23 and each of the reflective electrodes 15 is changed. Light transmitted through the liquid crystal layer 30 is thus modulated on a sub-pixel SPix basis.

Ambient light or the like serves as incident light that is incident on the display surface 1*a* of the display device 1, and reaches the reflective electrodes 15 after being transmitted through the second panel 3 and the liquid crystal layer 30. The incident light is reflected by the reflective electrodes 15 for the respective sub-pixels SPix. The thus-reflected light is modulated on a sub-pixel SPix basis and exits from the display surface 1*a*. An image is thereby displayed.

Figure 3:
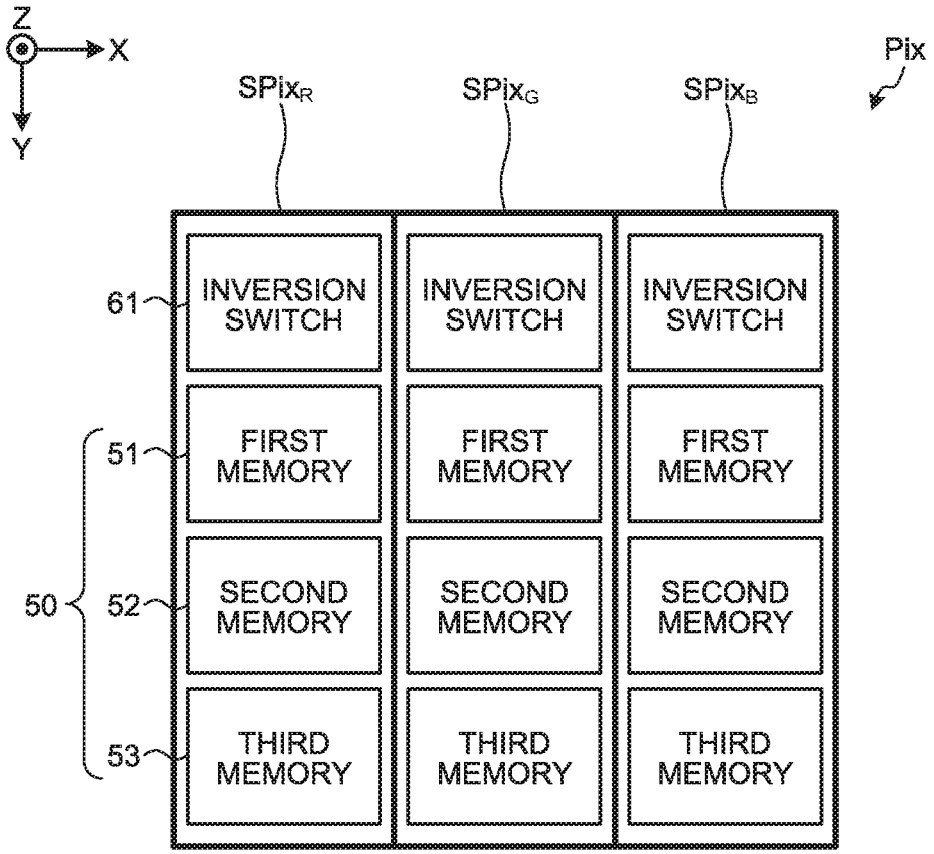
FIG. 3 illustrates an arrangement of sub-pixels in a pixel of the display device in the embodiment.

1-3. Circuit Configuration FIG. 3 illustrates an arrangement of sub-pixels SPix in each pixel Pix of the display device 1 in the embodiment. The pixel Pix includes the sub-pixel $SPix_R$ for R (red), the sub-pixel $SPix_G$ for G (green), and the sub-pixel $SPix_B$ for B (blue). The sub-pixels $SPix_R$, $SPix_G$, and $SPix_B$ are arranged in the X direction.

The sub-pixel $SPix_R$ includes a memory block 50 and an inversion switch 61. The memory block 50 includes a first memory 51, a second memory 52, and a third memory 53. The inversion switch 61, the first memory 51, the second memory 52, and the third memory 53 are arranged in the Y direction.

While the first memory 51, the second memory 52, and the third memory 53 are each described herein as a memory cell that stores therein one-bit data, this disclosure is not limited to this example. Each of the first memory 51, the second memory 52, and the third memory 53 may be a memory cell that stores therein data of two or more bits.

The inversion switch 61 is electrically coupled to between the sub-pixel electrode (reflective electrode) 15 (see FIG. 2) and the first, second, and third memories 51, 52, and 53. Based on a display signal supplied from the inversion drive circuit 7 and inverting in synchronization with the reference clock signal CLK, the inversion switch 61 inverts the sub-pixel data output from a selected one of the first memory 51, the second memory 52, and the third memory 53 on a certain cycle, and outputs the inverted sub-pixel data to the sub-pixel electrode 15.

The display signal inverts in the same cycle as a cycle in which the potential (common potential) of the common electrode 23 inverts.

The inversion switch 61 is an example of a switch circuit.

Figure 4:
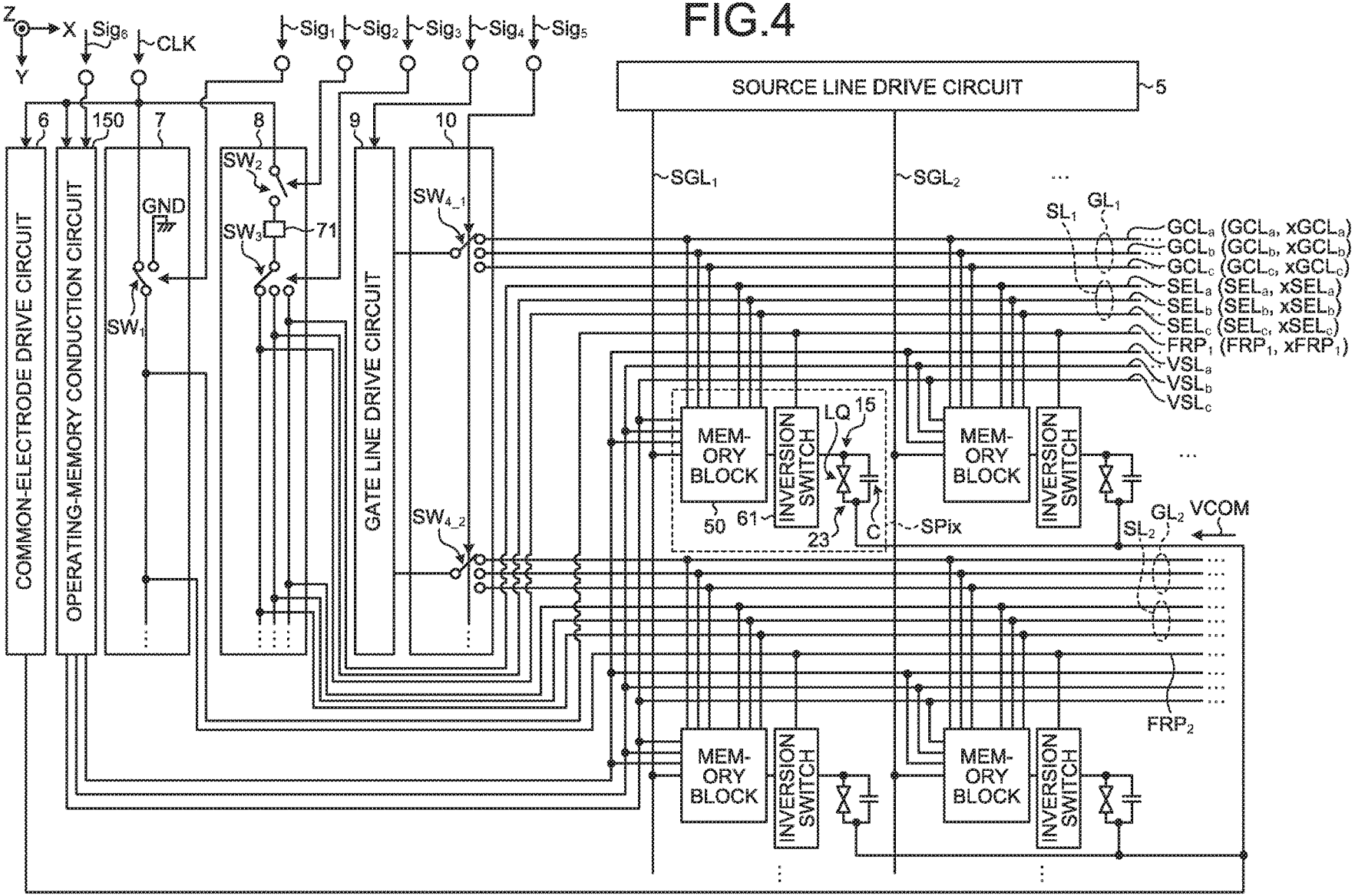
FIG. 4 illustrates a circuit configuration of the display device in the embodiment.

FIG. 4 illustrates a circuit configuration of the display device 1 in the embodiment. FIG. 4 illustrates the sub-pixels SPix in a 2-by-2 matrix among the sub-pixels SPix.

Each of the sub-pixels SPix includes, in addition to the memory block 50 and the inversion switch 61, liquid crystal LQ, a holding capacitance C, and the sub-pixel electrode 15 (see FIG. 2).

The common-electrode drive circuit 6 inverts a common potential VCOM common to the sub-pixels SPix in synchronization with the reference clock signal CLK, and outputs the thus inverted common potential VCOM to the common electrode 23 (see FIG. 2). The common-electrode drive circuit 6 may output the reference clock signal CLK as it is, as the common potential VCOM, to the common electrode 23. The common-electrode drive circuit 6 may output the reference clock signal CLK as the common potential VCOM to the common electrode 23 via a buffer circuit that amplifies a current driving capability.

The gate line drive circuit 9 includes M output terminals corresponding to the M rows of pixels Pix. Based on a control signal $Sig_4$ supplied from the timing controller 4*b*, the gate line drive circuit 9 sequentially outputs the gate signal from the M output terminals, the gate signal serving as a signal for selecting one of the M rows.

The gate line drive circuit 9 may be a scanner circuit configured to sequentially output the gate signal from M output terminals based on control signals $Sig_4$ (a scan start signal and a clock pulse signal). Alternatively, the gate line drive circuit 9 may be a decoder circuit configured to decode the control signal $Sig_4$ that has been encoded and output the gate signal to an output terminal designated by the control signal $Sig_4$.

The gate line selection circuit 10 includes M switches $SW_{4_1}$, $SW_{4_2}$, . . . corresponding to the M rows of pixels Pix. The M switches $SW_{4_1}$, $SW_{4_2}$, . . . are uniformly controlled in accordance with a control signal $Sig_5$ supplied from the timing controller 4*b*.

On the first panel 2, M gate line groups $GL_1$, $GL_2$, . . . are disposed corresponding to the pixels Pix in the respective M rows. Each of the M gate line groups $GL_1$, $GL_2$, . . . includes a first gate line $GCL_a$, a second gate line $GCL_b$, and a third gate line $GCL_c$. The first gate line $GCL_a$ is electrically coupled to the first memories 51 (see FIG. 3) of its corresponding row, the second gate line $GCL_b$ is electrically coupled to the second memories 52 (see FIG. 3) thereof, and the third gate line $GCL_c$ is electrically coupled to the third memories 53 (see FIG. 3) thereof. Each of the M gate line groups $GL_1$, $GL_2$, . . . is parallel to the X direction in the display region DA (see FIG. 1).

Each of the M switches $SW_{4_1}$, $SW_{4_2}$, . . . electrically couples the corresponding output terminal of the gate line drive circuit 9 to the corresponding first gate line $GCL_a$ if the control signal $Sig_5$ represents a first value. Each of the M switches $SW_{4_1}$, $SW_{4_2}$, . . . electrically couples the corresponding output terminal of the gate line drive circuit 9 to the corresponding second gate line $GCL_b$ if the control signal $Sig_5$ represents a second value. Each of the M switches $SW_{4_1}$, $SW_{4_2}$, . . . electrically couples the corresponding output terminal of the gate line drive circuit 9 to the corresponding third gate line $GCL_c$ if the control signal $Sig_5$ represents a third value.

When the output terminal of the gate line drive circuit 9 and the corresponding first gate line $GCL_a$ are electrically coupled together, the gate signal is supplied to the first memories 51 of the corresponding sub-pixels SPix. When the output terminal of the gate line drive circuit 9 and the corresponding second gate line $GCL_b$ are electrically coupled together, the gate signal is supplied to the second memories 52 of the corresponding sub-pixels SPix. When the output terminal of the gate line drive circuit 9 and the corresponding third gate line $GCL_c$ are electrically coupled together, the gate signal is supplied to the third memories 53 of the corresponding sub-pixels SPix.

On the first panel 2, N×3 source lines $SGL_1$, $SGL_2$, . . . are disposed corresponding to the N×3 columns of sub-pixels SPix. Each of the source lines $SGL_1$, $SGL_2$, . . . is parallel to the Y direction in the display region DA (see FIG. 1). The source line drive circuit 5 outputs the sub-pixel data to one of the three memories in each of the sub-pixels SPix through a corresponding one of the source lines $SGL_1$, $SGL_2$, . . . , the one memory having been selected by being supplied with the gate signal.

In accordance with the gate line GCL supplied with gate signal, each of the sub-pixels SPix that belong to one row supplied with a gate signal stores sub-pixel data in one memory among the first memory 51 to the third memory 53 therein, the sub-pixel data having been supplied through the corresponding source line SGL.

The memory selection circuit 8 includes a switch $SW_2$, a latch 71, and another switch $SW_3$. The switch $SW_2$ is controlled by a control signal $Sig_2$ supplied from the timing controller 4*b*.

When an image is displayed, the timing controller 4*b* outputs, to the switch $SW_2$, the control signal $Sig_2$ representing the first value. The switch $SW_2$ is turned on based on the control signal $Sig_2$ representing the first value. The reference clock signal CLK is thereby supplied to the latch 71.

When no image is displayed, the timing controller 4*b* outputs, to the switch $SW_2$, the control signal $Sig_2$ representing the second value. The switch $SW_2$ is turned off based on the control signal $Sig_2$ representing the second value. The reference clock signal CLK is thereby kept from being supplied to the latch 71.

When the reference clock signal CLK is supplied to the latch 71 with the switch $SW_2$ on, the latch 71 holds the high level of the reference clock signal CLK for one cycle of the reference clock signal CLK. When the reference clock signal CLK is not supplied to the latch 71 with the switch $SW_2$ off, the latch 71 holds the high level thereof.

On the first panel 2, M memory selection line groups $SL_1$, $SL_2$, . . . are disposed corresponding to the M rows of pixels Pix. Each of the M memory selection line group $SL_1$, $SL_2$, . . . includes: a first memory selection line $SEL_a$, a second memory selection line $SEL_b$, and a third memory selection line $SEL_c$. The first memory selection line $SEL_a$ is electrically coupled to the first memories 51 of the corresponding row, the second memory selection line $SEL_b$ is electrically coupled to the second memories 52 thereof, and a third memory selection line $SEL_c$ is electrically coupled to the third memories 53 thereof. Each of the M memory selection line groups $SL_1$, $SL_2$, . . . is parallel to the X direction in the display region DA (see FIG. 1).

The switch $SW_3$ is controlled by a control signal $Sig_3$ supplied from the timing controller 4*b*. The switch $SW_3$ electrically couples the output terminal of the latch 71 to the first memory selection lines $SEL_a$ in the respective M memory selection line groups $SL_1$, $SL_2$, . . . if the control signal $Sig_3$ represents the first value. The switch $SW_3$ electrically couples the output terminal of the latch 71 to the second memory selection lines $SEL_b$ in the respective M memory selection line groups $SL_1$, $SL_2$, . . . if the control signal $Sig_3$ represents the second value. The switch $SW_3$ electrically couples the output terminal of the latch 71 to the third memory selection lines $SEL_c$ in the respective M memory selection line groups $SL_1$, $SL_2$, . . . if the control signal $Sig_3$ represents the third value.

Each of the sub-pixels SPix modulates the liquid crystal layer based on the sub-pixel data stored in one memory among the first memory 51 to the third memory 53 corresponding to the memory selection line SEL to which a memory selection signal is supplied. Consequently, an image (frame) is displayed on the display surface.

On the first panel 2, M display signal lines $FRP_1$, $FRP_2$, . . . are disposed corresponding to the M rows of pixels Pix. Each of the M display signal lines $FRP_1$, $FRP_2$, . . . extends in the X direction within the display region DA (see FIG. 1). In a configuration such that the inversion switch 61 operates based not only on a display signal but also on an inverted display signal obtained by inverting the display signal, the display signal line FRP and the second display signal line xFRP are disposed for each row.

The one or two display signal lines disposed for each row is an example of a display signal line.

The inversion drive circuit 7 includes a switch $SW_1$. The switch $SW_1$ is controlled by a control signal $Sig_1$ supplied from the timing controller 4*b*. The switch $SW_1$ supplies the reference clock signal CLK to the display signal lines $FRP_1$, $FRP_2$, . . . if the control signal $Sig_1$ represents the first value. The potential of the electrodes 15 is thereby inverted in synchronization with the reference clock signal CLK. The switch $SW_1$ supplies the reference potential (ground potential) GND to the display signal lines $FRP_1$, $FRP_2$, . . . if the control signal $Sig_1$ represents the second value.

The operating-memory conduction circuit 150 turns on and off the supply of electric power to the first memory 51, the second memory 52, and the third memory 53, individually, that are contained in the memory block 50 of each of the sub-pixels SPix. Based on a control signal $Sig_h$ supplied from the timing controller 4*b*, the operating-memory conduction circuit 150 outputs operation signals to a first operation signal line $VSL_a$, a second signal operation signal line $VSL_b$, and a third operation signal line $VSL_c$. The operation signals are signals for turning on the supply of electric power to a memory desired to operate and turning off the supply of electric power to a memory not desired to operate, among the memories. The first operation signal line $VSL_a$ transmits the operation signal regarding the supply of electric power to the first memory 51. The second operation signal line $VSL_b$ transmits the operation signal regarding the supply of electric power to the second memory 52. The third operation signal line $VSL_c$ transmits the operation signal regarding the supply of electric power to the third memory 53.

Figure 5:
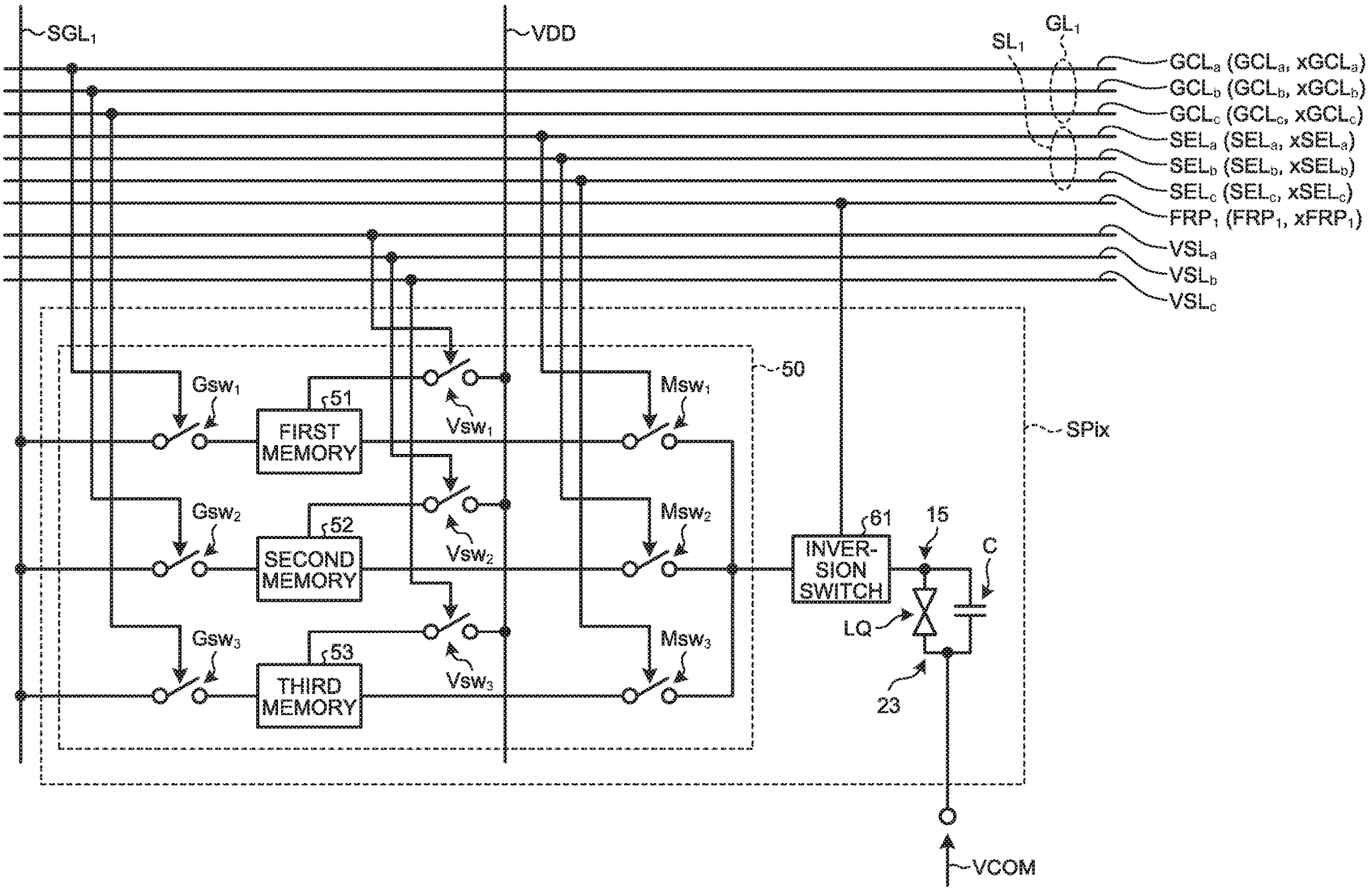
FIG. 5 illustrates a circuit configuration of the sub-pixel of the display device in the embodiment.

FIG. 5 illustrates a circuit configuration of the sub-pixel of the display device in the embodiment. FIG. 5 illustrates one of the sub-pixels SPix.

The sub-pixel SPix includes the memory block 50. The memory block 50 includes the first memory 51, the second memory 52, the third memory 53, switches $Gsw_1$ to $Gsw_3$, switches $Vsw_1$ to $Vsw_3$, and switches $Msw_1$ to $Msw_3$.

A control input terminal of the switch $Vsw_1$ is electrically coupled to the first operation signal line $VSL_a$. When a high-level operation signal is supplied to the first operation signal line $VSL_a$, the switch $Vsw_1$ is turned on and electrically couples the first memory 51 to a high-potential power supply line VDD. Thus, the supply of electric power to the first memory 51 is turned on, so that power for causing the first memory 51 to operate is supplied. That is, the first memory 51 operates when the switch $Vsw_1$ is on. In contrast, when a low-level operation signal is supplied to the first operation signal line $VSL_a$, the switch $Vsw_1$ is turned off and electrically decouples the first memory 51 from the high-potential power supply line VDD. Thus, the supply of electric power to the first memory 51 is turned off, so that power for causing the first memory 51 to operate is not supplied. That is, the first memory 51 does not operate when the switch $Vsw_1$ is off.

A control input terminal of the switch $Vsw_2$ is electrically coupled to the second operation signal line $VSL_b$. When a high-level operation signal is supplied to the second operation signal line $VSL_b$, the switch $Vsw_2$ is turned on and electrically couples the second memory 52 to the high-potential power supply line VDD. Thus, the supply of electric power to the second memory 52 is turned on, so that power for causing the second memory 52 to operate is supplied. That is, the second memory 52 operates when the switch $Vsw_2$ is on. In contrast, when a low-level operation signal is supplied to the second operation signal line $VSL_b$, the switch $Vsw_2$ is turned off and electrically decouples the second memory 52 from the high-potential power supply line VDD. Thus, the supply of electric power to the second memory 52 is turned off, so that power for causing the second memory 52 to operate is not supplied. That is, the second memory 52 does not operate when the switch $Vsw_2$ is off.

A control input terminal of the switch $Vsw_3$ is electrically coupled to the third operation signal line $VSL_c$. When a high-level operation signal is supplied to the third operation signal line $VSL_c$, the switch $Vsw_3$ is turned on and electrically couples the third memory 53 to the high-potential power supply line VDD. Thus, the supply of electric power to the third memory 53 is turned on, so that power for causing the third memory 53 to operate is supplied. That is, the third memory 53 operates when the switch $Vsw_3$ is on. In contrast, when a low-level operation signal is supplied to the third operation signal line $VSL_c$, the switch $Vsw_3$ is turned off and electrically decouples the third memory 53 from the high-potential power supply line VDD. Thus, the supply of electric power to the third memory 53 is turned off, so that power for causing the third memory 53 to operate is not supplied. That is, the third memory 53 does not operate when the switch $Vsw_3$ is off.

A control input terminal of the switch $Gsw_1$ is electrically coupled to the first gate line $GCL_a$. When a high-level gate signal is supplied to the first gate line $GCL_a$, the switch $Gsw_1$ is turned on to electrically couple the source line $SGL_1$ to an input terminal of the first memory 51. Thus, the sub-pixel data supplied to the source line $SGL_1$ is stored in the first memory 51 that is currently operating.

A control input terminal of the switch $Gsw_2$ is electrically coupled to the second gate line $GCL_b$. When a high-level gate signal is supplied to the second gate line $GCL_b$, the switch $Gsw_2$ is turned on to electrically couple the source line $SGL_1$ to an input terminal of the second memory 52. Thus, the sub-pixel data supplied to the source line $SGL_1$ is stored in the second memory 52 that is currently operating.

A control input terminal of the switch $Gsw_3$ is electrically coupled to the third gate line $GCL_c$. When a high-level gate signal is supplied to the third gate line $GCL_c$, the switch $Gsw_3$ is turned on to electrically couple the source line $SGL_1$ to an input terminal of the third memory 53. Thus, the sub-pixel data supplied to the source line $SGL_1$ is stored in the third memory 53 that is currently operating.

In a configuration such that the switches $Gsw_1$ to $Gsw_3$ each operate with a high-level gate signal, the gate line group $GL_1$ includes the first gate line $GCL_a$ to the third gate line $GCL_c$ as illustrated in FIG. 5. While the switch that operates based on a high-level gate signal is exemplified by an N-channel transistor, this disclosure is not limited thereto.

In contrast, in a configuration such that each of the switches $Gsw_1$ to $Gsw_3$ operates based not only on the gate signal but also on the inverted gate signal obtained by inverting the gate signal, the gate line group $GL_1$ includes not only the first gate line $GCL_a$ to the third gate line $GCL_c$ but also fourth gate line $xGCL_a$ to sixth gate line $xGCL_c$ to each of which the inverted gate signal is supplied. While the switch that operates based on the gate signal and the inverted gate signal is exemplified by a transfer gate, this disclosure is not limited thereto.

The inverted gate signal can be supplied to the fourth gate line $xGCL_a$ when the display device 1 includes an inverter circuit including an input terminal electrically coupled to the first gate line $GCL_a$ and an output terminal electrically coupled to the fourth gate line $xGCL_a$. Likewise, the inverted gate signal can be supplied to the fifth gate line $xGCL_b$ when the display device 1 includes an inverter circuit including an input terminal electrically coupled to the second gate line $GCL_b$ and an output terminal electrically coupled to the fifth gate line $xGCL_b$. Likewise, the inverted gate signal can be supplied to the sixth gate line $xGCL_c$ when the display device 1 includes an inverter circuit including an input terminal electrically coupled to the third gate line $GCL_c$ and an output terminal electrically coupled to the sixth gate line $xGCL_c$.

A control input terminal of the switch $Msw_1$ is electrically coupled to the first memory selection line $SEL_a$. When a high-level memory selection signal is supplied to the first memory selection line $SEL_a$, the switch $Msw_1$ is turned on and electrically couples the output terminal of the first memory 51 to an input terminal of the inversion switch 61. Thus, the sub-pixel data stored in the first memory 51 is supplied to the inversion switch 61.

A control input terminal of the switch $Msw_2$ is electrically coupled to the second memory selection line $SEL_b$. When a high-level memory selection signal is supplied to the second memory selection line $SEL_b$, the switch $Msw_2$ is turned on and electrically couples the output terminal of the second memory 52 to the input terminal of the inversion switch 61. Thus, the sub-pixel data stored in the second memory 52 is supplied to the inversion switch 61.

A control input terminal of the switch $Msw_3$ is electrically coupled to the third memory selection line $SEL_c$. When a high-level memory selection signal is supplied to the third memory selection line $SEL_c$, the switch $Msw_3$ is turned on and electrically couples the output terminal of the third memory 53 to the input terminal of the inversion switch 61.

Thus, the sub-pixel data stored in the third memory 53 is supplied to the inversion switch 61.

In a configuration such that each of the switches $Msw_1$ to $Msw_3$ operates based on a high-level memory selection signal, the memory selection line group $SL_1$ includes the first memory selection line $SEL_a$ to the third memory selection line $SEL_c$ as illustrated in FIG. 5. While the switch that operates based on a high-level gate signal is exemplified by an N-channel transistor, this disclosure is not limited thereto.

In contrast, in a configuration such that each of the switches $Msw_1$ to $Msw_3$ operates based not only on the memory selection signal but also on the inverted memory selection signal obtained by inverting the memory selection signal, the memory selection line group $SL_1$ includes not only the first memory selection line $SEL_a$ to the third memory selection line $SEL_c$ but also fourth memory selection line $xSEL_a$ to sixth memory selection line $xSEL_c$ to each of which the inverted memory selection signal is supplied. While the switch that operates based on the memory selection signal and the inverted memory selection signal is exemplified by a transfer gate, this disclosure is not limited thereto.

The inverted memory selection signal can be supplied to the fourth memory selection line $xSEL_a$ when the display device 1 includes an inverter circuit having an input terminal electrically coupled to the first memory selection line $SEL_a$ and an output terminal electrically coupled to the fourth memory selection line $xSEL_a$. Likewise, the inverted memory selection signal can be supplied to the fifth memory selection line $xSEL_b$ when the display device 1 includes an inverter circuit having an input terminal electrically coupled to the second memory selection line $SEL_b$ and an output terminal electrically coupled to the fifth memory selection line $xSEL_b$. Likewise, the inverted memory selection signal can be supplied to the sixth memory selection line $xSEL_c$ when the display device 1 includes an inverter circuit having an input terminal electrically coupled to the third memory selection line $SEL_c$ and an output terminal electrically coupled to the sixth memory selection line $xSEL_c$.

A display signal that inverts in synchronization with the reference clock signal CLK is supplied to the inversion switch 61 from a display signal line $FRP_1$. Based on the display signal, the inversion switch 61 supplies, to the sub-pixel electrode 15, the sub-pixel data stored in the first memory 51, the second memory 52, and the third memory 53 as it is or after inverting it.

The liquid crystal LQ and the holding capacitance C are interposed between the sub-pixel electrode 15 and the common electrode 23. The holding capacitance C holds the voltage between the sub-pixel electrode 15 and the common electrode 23. Molecules in the liquid crystal LQ change in orientation based on the voltage between the sub-pixel electrode 15 and the common electrode 23, so that a sub-pixel image is displayed.

In a configuration such that the inversion switch 61 operates based on a display signal, the single display signal line $FRP_1$ is included as illustrated in FIG. 5. In contrast, in a configuration such that the inversion switch 61 operates based not only on the display signal but also on the inverted display signal obtained by inverting the display signal, a second display signal line $xFRP_1$ is included in addition to the display signal line $FRP_1$. Further, the display device 1 includes an inverter circuit including an input terminal electrically coupled to the display signal line $FRP_1$ and an output terminal electrically coupled to the second display signal line $xFRP_1$. With this configuration, the inverted display signal can be supplied to the second display signal line $xFRP_1$.

Figure 6:
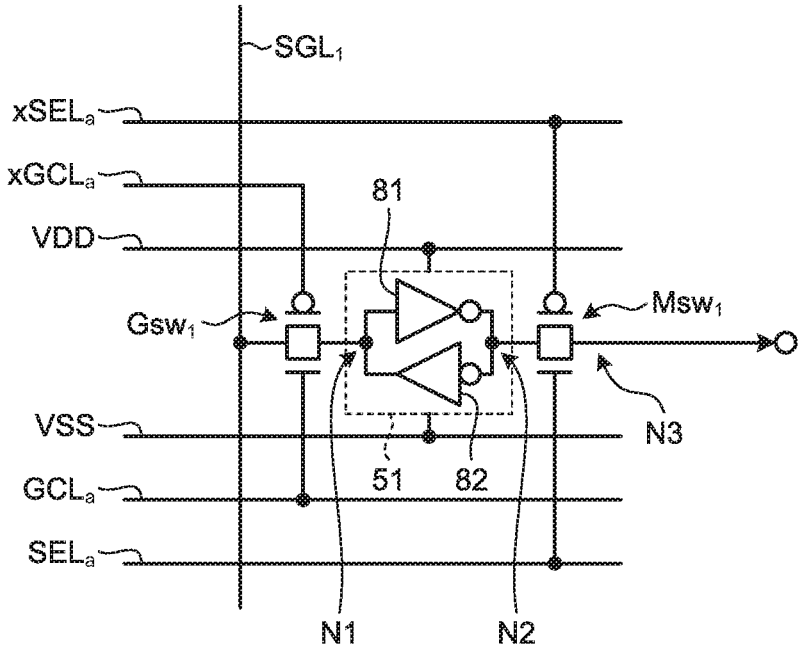
FIG. 6 illustrates a circuit configuration of a memory in the sub-pixel of the display device in the embodiment.

FIG. 6 illustrates a circuit configuration of each memory in the sub-pixel SPix of the display device 1 in the embodiment. FIG. 6 illustrates a circuit configuration of the first memory 51. The circuit configurations of the second memory 52 and the third memory 53 are identical to the circuit configuration of the first memory 51, and illustration and description thereof is therefore omitted.

The first memory 51 has a static random access memory (SRAM) cell structure that includes an inverter circuit 81 and another inverter circuit 82. The inverter circuit 82 is electrically coupled to the inverter circuit 81 in parallel and in a direction opposite to the direction thereof. The input terminal of the inverter circuit 81 and the output terminal of the inverter circuit 82 constitute a node N1, and the output terminal of the inverter circuit 81 and the input terminal of the inverter circuit 82 constitute a node N2. The inverter circuits 81 and 82 operate with power supplied from a high-potential power supply line VDD and a low-potential power supply line VSS.

The node N1 is electrically coupled to the output terminal of the switch $Gsw_1$. The node N2 is electrically coupled to the input terminal of the switch $Msw_1$.

FIG. 6 illustrates an example in which a transfer gate is used as the switch $Gsw_1$. One control input terminal of the switch $Gsw_1$ is electrically coupled to the first gate line $GCL_a$. The other control input terminal of the switch $Gsw_1$ is electrically coupled to the fourth gate line $xGCL_a$. The fourth gate line $xGCL_a$ is supplied with the inverted gate signal obtained by inverting the gate signal supplied to the first gate line $GCL_a$.

The input terminal of the switch $Gsw_1$ is electrically coupled to the source line $SGL_1$. The output terminal of the switch $Gsw_1$ is electrically coupled to the node N1. When the gate signal supplied to the first gate line $GCL_a$ is set to high-level and the inverted gate signal supplied to the fourth gate line $xGCL_a$ is set to low-level, the switch $Gsw_1$ is turned on and electrically couples the source line $SGL_1$ to the node N1. Thus, the sub-pixel data supplied to the source line $SGL_1$ is stored in the first memory 51.

FIG. 6 illustrates an example in which a transfer gate is used as the switch $Msw_1$. One control input terminal of the switch $Msw_1$ is electrically coupled to the first memory selection line $SEL_a$. The other control input terminal of the switch $Msw_1$ is electrically coupled to the fourth memory selection line $xSEL_a$. The fourth memory selection line $xSEL_a$ is supplied with the inverted memory selection signal obtained by inverting the memory selection signal supplied to the first memory selection line $SEL_a$.

The input terminal of the switch $Msw_1$ is electrically coupled to the node N2. The output terminal of the switch $Msw_1$ is electrically coupled to a node N3. The node N3 is an output node of the first memory 51 and is electrically coupled to the inversion switch 61 (see FIG. 5). When the memory selection signal supplied to the first memory selection line $SEL_a$ is set to high-level and the inverted memory selection signal supplied to the fourth memory selection line $xSEL_a$ is set to low-level, the switch $Msw_1$ is turned on. Thus, the node N2 is electrically coupled to the input terminal of the inversion switch 61 via the switch $Msw_1$ and the node N3. Thus, the sub-pixel data stored in the first memory 51 is supplied to the inversion switch 61.

When the switches $Gsw_1$ and $Msw_1$ are both off, the sub-pixel data circulates through a loop formed by the inverter circuits 81 and 82. The first memory 51 consequently keeps holding the sub-pixel data.

While the above description illustrates the first memory 51 as an SRAM in the embodiment, this disclosure is not limited to this example. Other examples of the first memory 51 include, but are not limited to, a dynamic random access memory (DRAM).

Figure 7:
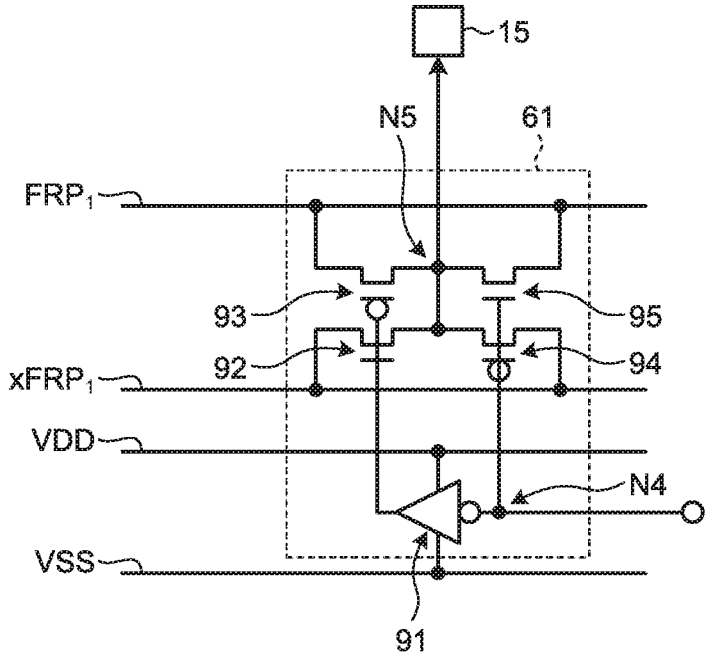
FIG. 7 illustrates a circuit configuration of an inversion switch in the sub-pixel of the display device in the embodiment.

FIG. 7 illustrates a circuit configuration of the inversion switch 61 in the sub-pixel SPix of the display device 1 in the embodiment. The inversion switch 61 includes an inverter circuit 91, N-channel transistors 92 and 95, and P-channel transistors 93 and 94.

The input terminal of the inverter circuit 91, the gate terminal of the P-channel transistor 94, and the gate terminal of the N-channel transistor 95 are coupled to a node N4. The node N4 is an input node of the inversion switch 61 and is electrically coupled to the nodes N3 of the first memory 51, the second memory 52, and the third memory 53. The sub-pixel data is supplied to the node N4 from the first memory 51, the second memory 52, and the third memory 53. The inverter circuit 91 operates with power supplied from the high-potential power supply line VDD and the low-potential power supply line VSS.

One of the source and the drain of the N-channel transistor 92 is electrically coupled to the second display signal line $xFRP_1$. The other one of the source and the drain of the N-channel transistor 92 is electrically coupled to a node N5.

One of the source and the drain of the P-channel transistor 93 is electrically coupled to the display signal line $FRP_1$. The other one of the source and the drain of the P-channel transistor 93 is electrically coupled to the node N5.

One of the source and the drain of the P-channel transistor 94 is electrically coupled to the second display signal line $xFRP_1$. The other one of the source and the drain of the P-channel transistor 94 is electrically coupled to the node N5.

One of the source and the drain of the N-channel transistor 95 is electrically coupled to the display signal line $FRP_1$. The other one of the source and the drain of the N-channel transistor 95 is electrically coupled to the node N5.

The node N5 is the output node of the inversion switch 61 and is electrically coupled to the reflective electrode (sub-pixel electrode) 15.

When the sub-pixel data supplied from the first memory 51, the second memory 52, or the third memory 53 is high-level, an output signal from the inverter circuit 91 is low-level. When an output signal from the inverter circuit 91 is low-level, the N-channel transistor 92 is off and the P-channel transistor 93 is on.

When the sub-pixel data supplied from the first memory 51, the second memory 52, or the third memory 53 is high-level, the P-channel transistor 94 is off and the N-channel transistor 95 is on.

Therefore, when the sub-pixel data supplied from the first memory 51, the second memory 52, or the third memory 53 is high-level, the display signal supplied to the display signal line $FRP_1$ is supplied to the sub-pixel electrode 15 via the P-channel transistor 93 and the N-channel transistor 95.

The display signal supplied to the display signal line $FRP_1$ inverts in synchronization with the reference clock signal CLK. The common potential supplied to the common electrode 23 also inverts in phase with the display signal and in synchronization with the reference clock signal CLK. When the display signal and the common potential are in phase with each other, the potentials of the reflective electrode and the common electrode facing the reflective electrode with liquid crystal therebetween, are consequently in phase with each other. As a result, substantially no voltage is applied to the liquid crystal LQ, and liquid crystal molecules do not change in direction of orientation (keep their initial orientation state). Thus, the sub-pixel displays black. That is, the sub-pixel is in a state not transmitting the reflected light, in other words, a state not displaying colors with the color filter not transmitting the reflected light.

When the sub-pixel data supplied from the first memory 51, the second memory 52, or the third memory 53 is low-level, an output signal from the inverter circuit 91 is high-level. When an output signal from the inverter circuit 91 is high-level, the N-channel transistor 92 is on and the P-channel transistor 93 is off.

When the sub-pixel data supplied from the first memory 51, the second memory 52, or the third memory 53 is low-level, the P-channel transistor 94 is on and the N-channel transistor 95 is off.

Therefore, when the sub-pixel data supplied from the first memory 51, the second memory 52, or the third memory 53 is low level data, the inverted display signal supplied to the second display signal line $xFRP_1$ is supplied to the sub-pixel electrode 15 via the P-channel transistor 92 and the N-channel transistor 94.

The inverted display signal supplied to the second display signal line $xFRP_1$ inverts in synchronization with the reference clock signal CLK. The common potential supplied to the common electrode 23 inverts, out of phase with the display signal, in synchronization with the reference clock signal CLK. When the display signal and the common potential are out of phase with each other, the potentials of the reflective electrode and the common electrode facing the reflective electrode with liquid crystal therebetween, are consequently out of phase with each other. As a result, voltage is applied to the liquid crystal LQ, and liquid crystal molecules change in direction of orientation. Thus, the sub-pixel displays white (a state transmitting the reflected light, that is, a state displaying colors with the color filter transmitting the reflected light). Thus, the display device 1 can implement a common inversion driving method. In this example, the common potential applied to the common electrode 23 is assumed to be out of phase with the display signal on the basis of the display signal. However, a display signal that is supplied to the display signal line FRP may be defined as being in phase with the common potential, and a display signal that is supplied to the second display signal line xFRP may be defined as being out of phase with the common potential, on the basis of the common potential. In a specific example, a potential of an alternating-current signal that is the same as the common potential is supplied to the display signal line FRP in phase therewith, while a potential that is in opposite phase with the common potential is supplied to the second display signal line xFRP.

Figure 8:
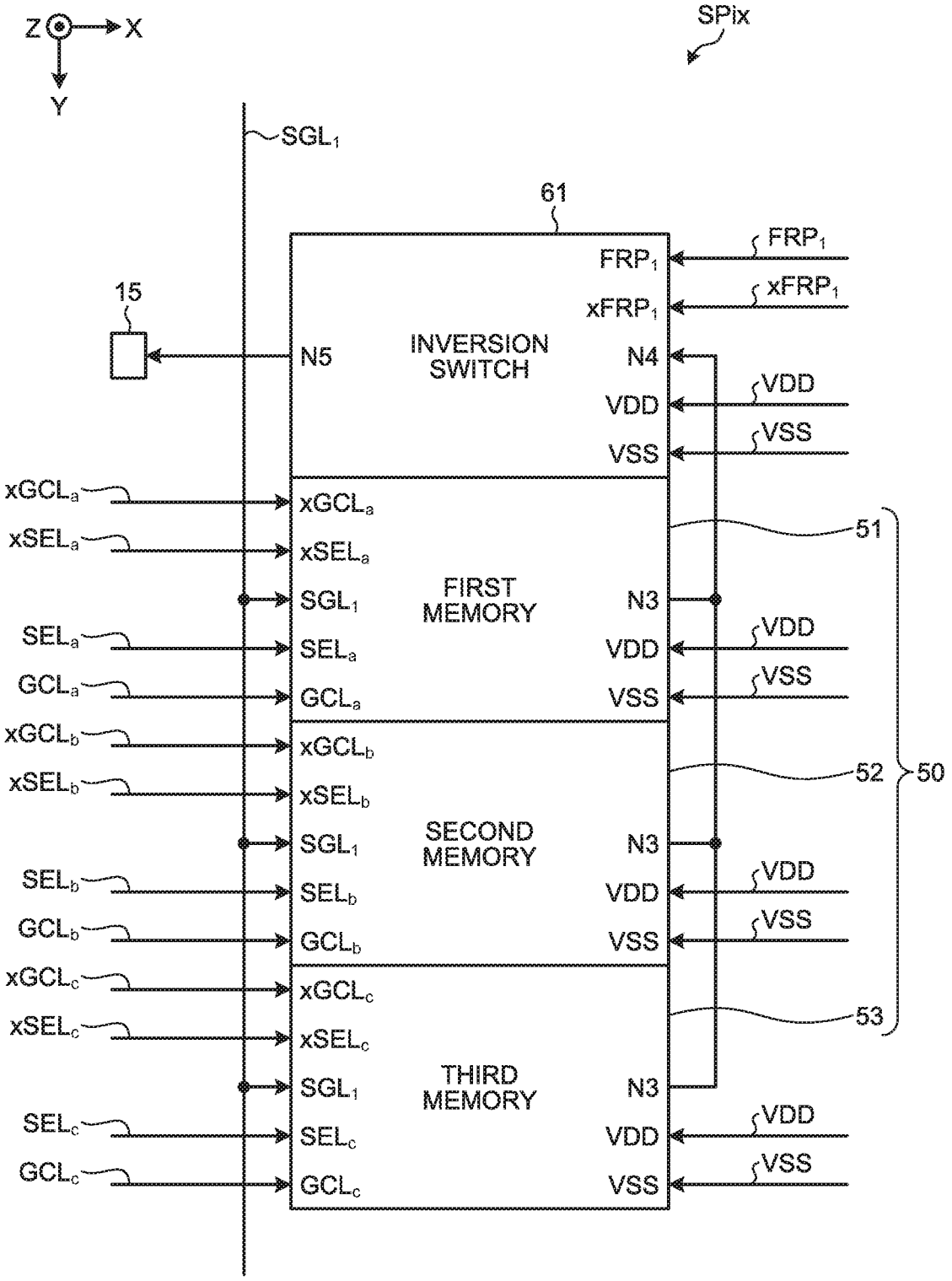
FIG. 8 schematically illustrates a layout of the sub-pixel of the display device in the embodiment.

FIG. 8 schematically illustrates a layout of the sub-pixel SPix of the display device 1 in the embodiment. The inversion switch 61, the first memory 51, the second memory 52, and the third memory 53 are arranged in the Y direction. The nodes N3, which are respective output nodes of the first memory 51, the second memory 52, and the third memory 53 are electrically coupled to the node N4, which is an input node of the inversion switch 61. The node N5, which is an output node of the inversion switch 61, is electrically coupled to the sub-pixel electrode 15.

The first memory 51 is electrically coupled to the first gate line $GCL_a$, the fourth gate line $xGCL_a$, the first memory selection line $SEL_a$, the fourth memory selection line $xSEL_a$, the source line $SGL_1$, the high-potential power supply line VDD, and the low-potential power supply line VSS. The first memory 51 and the high-potential power supply line VDD are electrically coupled to each other only when the switch $Vsw_1$ is on. When the first memory 51 and the high-potential power supply line VDD are electrically coupled to each other, the difference between the potentials of the high-potential power supply line VDD and the low-potential power supply line VSS causes power to be supplied to the first memory 51. The configurations of the second memory 52 and the third memory 53 are identical to that of the first memory 51, and description thereof is therefore omitted.

The inversion switch 61 is electrically coupled to the display signal line $FRP_1$, the second display signal line $xFRP_1$, the high-potential power supply line VDD, and the low-potential power supply line VSS.

1-4. Operation

Figure 9:
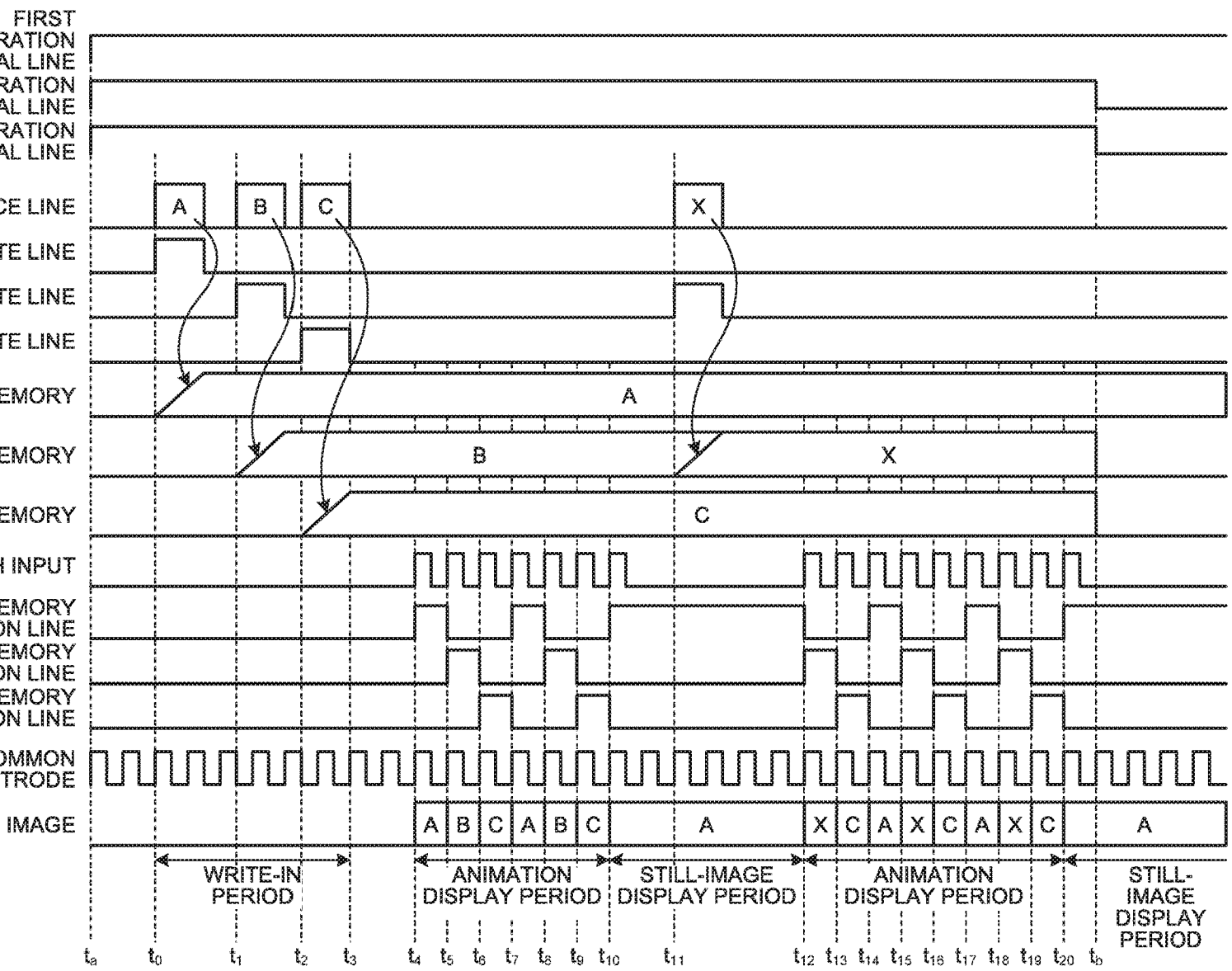
FIG. 9 is a timing chart illustrating operation timings of the display device in the embodiment.

FIG. 9 is a timing chart illustrating operation timings of the display device 1 in the embodiment. Throughout the entire period in FIG. 9, the common-electrode drive circuit 6 supplies, to the common electrode 23, a common potential that inverts in synchronization with the reference clock signal CLK.

A period from timing $t_0$ to timing $t_3$ is a period in which to write the sub-pixel data into the first memory 51 to the third memory 53 included in each of the (N×3) sub-pixels SPix that belong to one of the rows.

First, before timing $t_0$, the operating-memory conduction circuit 150 outputs operation signals for turning on the supply of electric power to memories in which sub-pixel data is to be stored, among the memories (the first memories 51, the second memories 52, and the third memories 53) included in the respective sub-pixels SPix. In FIG. 9, for a period from timing $t_0$ to timing $t_3$, the sub-pixel data is written into the first memories 51, the second memories 52, and the third memories 53. For this reason, the operating-memory conduction circuit 150 starts supplying a high-level operation signal to the first operation signal line $VSL_a$, the second operation signal line $VSL_b$, and the third operation signal line $VSL_c$ at timing $t_0$ before timing $t_0$. Thus, the supply of electric power to the first memory 51, the second memory 52, and the third memory 53 is turned on, which allows sub-pixel data to be stored in the first memories 51, the second memories 52, and the third memories 53.

At timing $t_0$, the timing controller 4*b* outputs the control signal $Sig_5$ set to the first value to the switch $SW_4$ in the gate line selection circuit 10. The switch $SW_4$ electrically couples the output terminal of the gate line drive circuit 9 to the first gate line $GCL_a$. The gate line drive circuit 9 outputs a gate signal to the first gate line $GCL_a$ of each of the rows. When a high-level gate signal is supplied to the first gate line $GCL_a$, the first memories 51 in the respective sub-pixels SPix that belong to the row are selected as memories into which the sub-pixel data is written.

At timing $t_0$, the source line drive circuit 5 outputs sub-pixel data for displaying an image (frame) of "A" to the source lines SGL. Thus, the sub-pixel data for displaying the image (frame) of "A" is written into the individual first memories 51 in the respective sub-pixels SPix that belong to the row.

In a period from timing $t_0$ to timing $t_1$, this operation is line-sequentially performed on each of the first to the M-th rows. Thus, signals for forming the image of "A" are written into and stored in the first memories in all of the sub-pixels SPix.

The same operation is performed from timing $t_1$ to timing $t_2$, so that signals for forming the image of "B" are written into and stored in the second memories in all of the sub-pixels SPix. The same operation is performed from timing $t_2$ to timing $t_3$, so that signals for forming the image of "C" are written into and stored in the third memories in all of the sub-pixels SPix.

A period from timing $t_4$ to timing $t_{10}$ is an animation display (moving image display) period in which to sequentially switch an image to be displayed from one image to another among the three images of "A", "B", and "C" (three frames).

At timing $t_4$, the timing controller 4*b* outputs the control signal $Sig_2$ set to the first value to the switch $SW_2$ in the memory selection circuit 8. The switch $SW_2$ is turned on based on the control signal $Sig_2$ set to the first value and supplied from the timing controller 4*b*. Thus, the reference clock signal CLK is supplied to the latch 71.

At timing $t_4$, the timing controller 4*b* also outputs the control signal $Sig_3$ set to the first value to the switch $SW_3$ in the memory selection circuit 8. The switch $SW_3$ electrically couples the output terminal of the latch 71 to the first memory selection lines $SEL_a$ in the respective M memory selection line groups $SL_1$, $SL_2$, . . . . Thus, the memory selection signals are supplied to the first memory selection lines $SEL_a$ of the respective M memory selection line groups $SL_i$, $SL_2$, . . . .

The first memories 51 coupled to the respective first memory selection lines $SEL_a$ output the sub-pixel data for displaying the image of "A" to the corresponding inversion switches 61. Thus, at timing $t_4$, the display device 1 displays the image of "A".

The same operation is performed at timing $t_5$, so that the display device 1 displays the image of "B", and performed at timing $t_6$, so that the display device 1 displays the image of "C". The operation performed on the second memories 52 at timing $t_5$ and the operation performed on the third memories 53 at timing $t_6$ are substantially the same as the operation performed on the first memories 51 at timing $t_4$, and description thereof is therefore omitted.

Operation that the components perform for a period from timing $t_7$ to timing $t_9$ is the same as operation that they perform for a period from timing $t_4$ to timing $t_6$. Description thereof is therefore omitted.

As described above, during a period from timing $t_4$ to timing $t_{10}$, the display device 1 can provide animation display (moving image display) in which an image to be displayed sequentially switched from one to another among the three images of "A", "B", and "C" (three frames).

A period from timing $t_{10}$ to timing $t_{12}$ is a still-image display period in which the image of "A" is displayed.

At timing $t_{10}$, the timing controller 4*b* outputs the control signal $Sig_2$ set to the second value to the switch $SW_2$ in the memory selection circuit 8. The switch $SW_2$ is turned off based on the control signal $Sig_2$ set to the second value and supplied from the timing controller 4*b*. Thus, the reference clock signal CLK is kept from being supplied to the latch 71. The latch 71 holds the high level.

At timing $t_{10}$, the timing controller 4*b* also outputs the control signal $Sig_3$ set to the first value to the switch $SW_3$ in the memory selection circuit 8. The switch $SW_3$ electrically couples the output terminal of the latch 71 to the first memory selection lines $SEL_a$ in the respective M memory selection line groups $SL_1$, $SL_2$, . . . . The display device 1 displays the image of "A" as a still image for a period from timing $t_{10}$ to timing $t_{12}$ through driving performed in the same manner as described above.

At timing $t_{11}$ in the still-image display period for which the image of "A" is displayed as a still image, sub-pixel data for displaying an image (frame) of "X" is written into the second memories 52 in the respective sub-pixels SPix.

At timing $t_{11}$, the timing controller 4*b* outputs the control signal $Sig_5$ set to the second value to the switch $SW_4$ in the gate line selection circuit 10. The switch $SW_4$ electrically couples the output terminal of the gate line drive circuit 9 to the second gate line $GCL_b$. The gate line drive circuit 9 outputs a gate signal to the second gate line $GCL_b$ of each of the rows. When a high-level gate signal is supplied to the second gate line $GCL_b$, the second memories 52 in the respective sub-pixels SPix that belong to the row are selected as memories into which the sub-pixel data is written.

At timing $t_{11}$, the source line drive circuit 5 outputs sub-pixel data for displaying the image of "X" to the source lines SGL. Thus, the sub-pixel data for displaying the image of "X" is written into the individual second memories 52 in the respective sub-pixels SPix that belong to the row.

The display device 1 can write the sub-pixel data of the image (frame) of "X" into the second memories 52 in the respective sub-pixels SPix by repeating, M times, the same operation as the operation performed at timing $t_{11}$.

FIG. 9 illustrates a case in which, at timing $t_{11}$ in the still-image display period for which the image of "A" is displayed as a still image, the sub-pixel data for displaying the image of "X" is written into the second memories 52 in the respective sub-pixels SPix. However, it is also possible to, for example, write the sub-pixel data for displaying the image of "X" into the second memories 52 in the respective sub-pixels SPix in a period from timing $t_6$ to timing $i_8$ in which the images of "C" and "A" are displayed as animations (displayed as moving images) during the animation display (moving image display) period.

A period after timing $t_{12}$ is an animation display (moving image display) period in which to sequentially switch an image to be displayed from one to another among the three images of "X", "C", and "A" (three frames).

At timing $t_{12}$, the timing controller 4*b* outputs the control signal $Sig_2$ set to the second value to the switch $SW_2$ in the memory selection circuit 8. The switch $SW_2$ is turned on based on the control signal $Sig_2$ set to the first value and supplied from the timing controller 4*b*. Thus, the reference clock signal CLK is supplied to the latch 71.

At timing $t_{12}$, the timing controller 4*b* also outputs the control signal $Sig_3$ set to the second value to the switch $SW_3$ in the memory selection circuit 8. The switch $SW_3$ electrically couples the output terminal of the latch 71 to the second memory selection line lines $SEL_b$ in the respective M memory selection line groups $SL_1$, $SL_2$, . . . . Thus, the memory selection signals are supplied to the second memory selection lines $SEL_b$ of the respective M memory selection line groups $SL_1$, $SL_2$, . . . .

The second memories 52 coupled to the respective second memory selection lines $SEL_b$ output the sub-pixel data for displaying the image "X" to the corresponding inversion switches 61. Thus, at timing $t_{12}$, the display device 1 displays the image of "X".

Operation that the components perform for a period from timing $t_{13}$ to timing $t_{14}$ is the same as operation that they perform for a period from timing $t_6$ to timing $t_7$. Description thereof is therefore omitted.

Operation that the components perform for a period from timing $t_{15}$ to timing $t_{20}$ is the same as operation that they perform for a period from timing $t_{12}$ to timing $t_{14}$. Description thereof is therefore omitted.

In FIG. 9, in the still-image display period from timing $t_{20}$, the image of "A" is displayed, and the images of "X" and "C" are not displayed. For this reason, the second memories 52, which have had sub-pixel data for displaying the image of "X" stored therein, and the third memories 53, which have had sub-pixel data for displaying the image of "C" stored therein, no longer need to keep storing the sub-pixel data therein from timing $t_{20}$. Accordingly, the supply of electric power to the second memories 52 and the third memories 53 is turned off, which can reduce the power consumption of the second memories 52 and the third memories 53 during the still-image display period from timing $t_{20}$.

The operating-memory conduction circuit 150 starts supplying a low-level operation signal to each of the second operation signal line $VSL_b$ and the third operation signal line $VSL_c$ at timing $t_b$ after timing $t_{20}$. Thus, the supply of electric power to the second memories 52 and the third memories 53 is turned off. The second memories 52 and the third memories 53 stop operating, so that the sub-pixel data stored in the second memories 52 and the third memories 53 is deleted. The first memories 51, in which sub-pixel data for displaying the image of "A" is stored, needs to keep operating from timing $t_{20}$ as in a period before timing $t_{20}$. For this reason, the operating-memory conduction circuit 150 supplies a high-level operation signal to the first operation signal line $VSL_a$ also from timing $t_{20}$ as in the period before timing $t_{20}$.

The timing at which the operating-memory conduction circuit 150 switches the operation signal supplied to each of the second operation signal line $VSL_b$ and the third operation signal line $VSL_c$ from a high level to a low level may be a timing later than the last timing when the sub-pixel data for displaying the images of "X" and "C" are needed during the animation display period before timing $t_{20}$. For example, the operating-memory conduction circuit 150 may switch the operation signal to be supplied to the second operation signal line $VSL_b$ from a high level to a low level at any timing after timing $t_{19}$.

While FIG. 9 illustrates a case in which the image of "A" is displayed in the still-image display period from timing $t_{20}$, the image of "X" or "C" may be displayed in the period. In such a case, the operating-memory conduction circuit 150 outputs operation signals so as to turn on the supply of electric power to memories in which sub-pixel data corresponding to an image to be displayed within the still-image display period after timing $t_{20}$ is stored, among the memories (the first memories 51, the second memories 52, and the third memories 53), and to turn off the supply of electric power to the other memories.

Also during the animation display period, the operating-memory conduction circuit 150 may output operation signals to turn on the supply of electric power to two memories among the three memories (the first memory 51, the second memory 52, and the third memory 53) in each of the sub-pixels and to turn off the supply of electric power to the one other memory. In such a case, the animation display period constitutes a moving image display period in which to sequentially switch two images (two frames) from one set to another set, the two images being two from the images of "A", "B", and "C" or from the images of "A", "X", and "C".

The display device disclosed in JP-A-9-212140 switches a plurality of memories from one to another in each of a plurality of pixels by performing line sequential scanning with scan signals. Therefore, the display device disclosed in JP-A-9-212140 needs a one-frame period to complete the switching from memories to other memories for all of the pixels. That is, the display device disclosed in JP-A-9-212140 needs a one-frame period to change an image (frame). In contrast, the display device 1 in the embodiment is configured such that the memory selection circuit 8 disposed outside the display region DA concurrently selects the first memories 51, the second memories 52, or the third memories 53 in the respective sub-pixels SPix. Consequently, the display device 1 can display one image (one frame) among three images (three frames) by switching selection of a memory from one to another among the first memory 51 to the third memory 53 in each of the sub-pixels SPix. Thus, the display device 1 can change an entire display image in a short amount of time. The display device 1 enables animation display (moving image display) by sequentially switching selection of a memory from one to another among the first memory 51 to the third memory 53 in each of the sub-pixels SPix.

In contrast, the display device 1 in the embodiment is configured such that the gate line selection circuit 10 disposed in the frame region GD selects the first memories 51, the second memories 52, or the third memories 53 when sub-pixel data is written. The display device 1 is also configured such that the memory selection circuit 8 selects the first memories 51, the second memories 52, or the third memories 53 when sub-pixel data is read out. This configuration makes it unnecessary for the respective pixels Pix to include circuits for switching memories. Thus, the display device 1 can meet the demand for making image display panels further reduced in size and higher in definition.

In the display device disclosed in JP-A-9-212140, the memories in each pixel is kept operating in an image information storable state. Therefore, regardless of whether memories are being switched, the display device disclosed in JP-A-9-212140 consumes power for causing the memories to operate. That is, the display device in JP-A-9-212140 cannot reduce power consumption for causing memories not in use to operate even while the memories are not being switched.

In contrast, the display device 1 in the embodiment includes: the high-potential power supply line VDD corresponding to a potential line; switches (for example, the switches $Vsw_1$ to $Vsw_3$) corresponding to conduction switches; and the operating-memory conduction circuit 150. The potential line has a potential applied thereto that causes a plurality of memories (for example, the first memory 51, the second memory 52, and the third memory 53) in each memory block 50 to operate. At least one conduction switch is provided for at least one of these memories (the first memory 51, the second memory 52, and the third memory 53) on a one-to-one basis. Each conduction switch is configured to switch between electrically coupling and electrically uncoupling the potential line and a corresponding one memory. The operating-memory conduction circuit 150 outputs, to the conduction switch, an operation signal determining whether to electrically couple or uncouple the potential line and the corresponding one memory.

Each of the memories is capable of storing the corresponding sub-pixel data only when being coupled to the potential line. This configuration can uncouple the memories not in use, that is, the memories that do not need to have sub-pixel data stored therein, from the potential line, and thus can prevent the memories from consuming electric power. Thus, power consumption can be further reduced.

Furthermore, in this embodiment, each of the memories in the memory block 50 is provided with one of the conduction switches on a one-to-one basis. Therefore, a combination of a memory or memories supplied with electric power and a memory or memories supplied with no electric power can be determined as desired. Thus, it is possible to select one desired memory from memories in each memory block 50, as a memory to be supplied with electric power in the still-image display period. It is also possible to select two desired memories from memories in each memory block 50, as memories to be supplied with electric power in the animation display (moving image display) period in which to sequentially switch two images (two frames) from one set to another set. Likewise, when all of the memories are not to be used, the supply of electric power to all of the memories not in use can be turned off to reduce power consumption.

The display device 1 in the embodiment further includes at least one operation signal line (for example, the first operation signal line $VSL_a$, the second operation signal line $VSL_b$, and/or the third operation signal line $VSL_c$). The conduction switch provided for one of the memories in the memory block 50 is coupled to one operation signal line. One operation signal line transmits an operation signal to the conduction switch provided for one memory included in each of the memory blocks 50 included in more than one of the sub-pixels SPix. For example, the first operation signal line $VSL_a$ transmits an operation signal from the operating-memory conduction circuit 150 to the switch $Vsw_1$ provided for the first memory 51 included in each of the sub-pixels SPix. The second operation signal line $VSL_b$ transmits an operation signal from the operating-memory conduction circuit 150 to the switch $Vsw_2$ provided for the second memory 52 included in each of the sub-pixels SPix. The third operation signal line $VSL_c$ transmits an operation signal from the operating-memory conduction circuit 150 to the switch $Vsw_3$ provided for the third memory 53 included in each of the sub-pixels SPix. Therefore, the supply of electric power to the memories in each of the memory blocks 50 included in the sub-pixels SPix can be controlled by means of the at least one operation signal line. Thus, the output of operation signals from the operating-memory conduction circuit 150 can be controlled in a further simplified manner.

2. MODIFICATION

Figure 10:
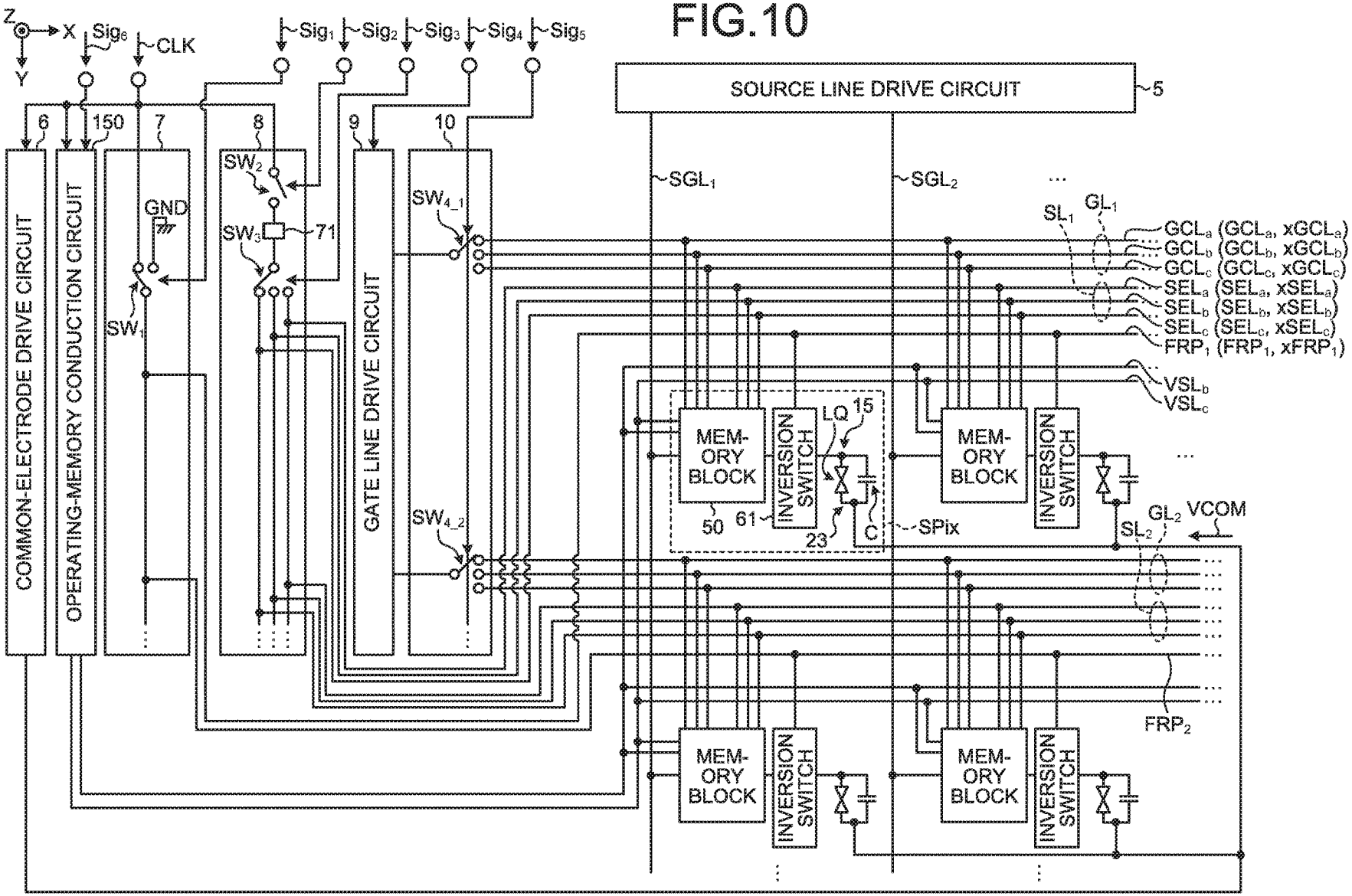
FIG. 10 illustrates a circuit configuration of a display device in a modification.
Figure 11:
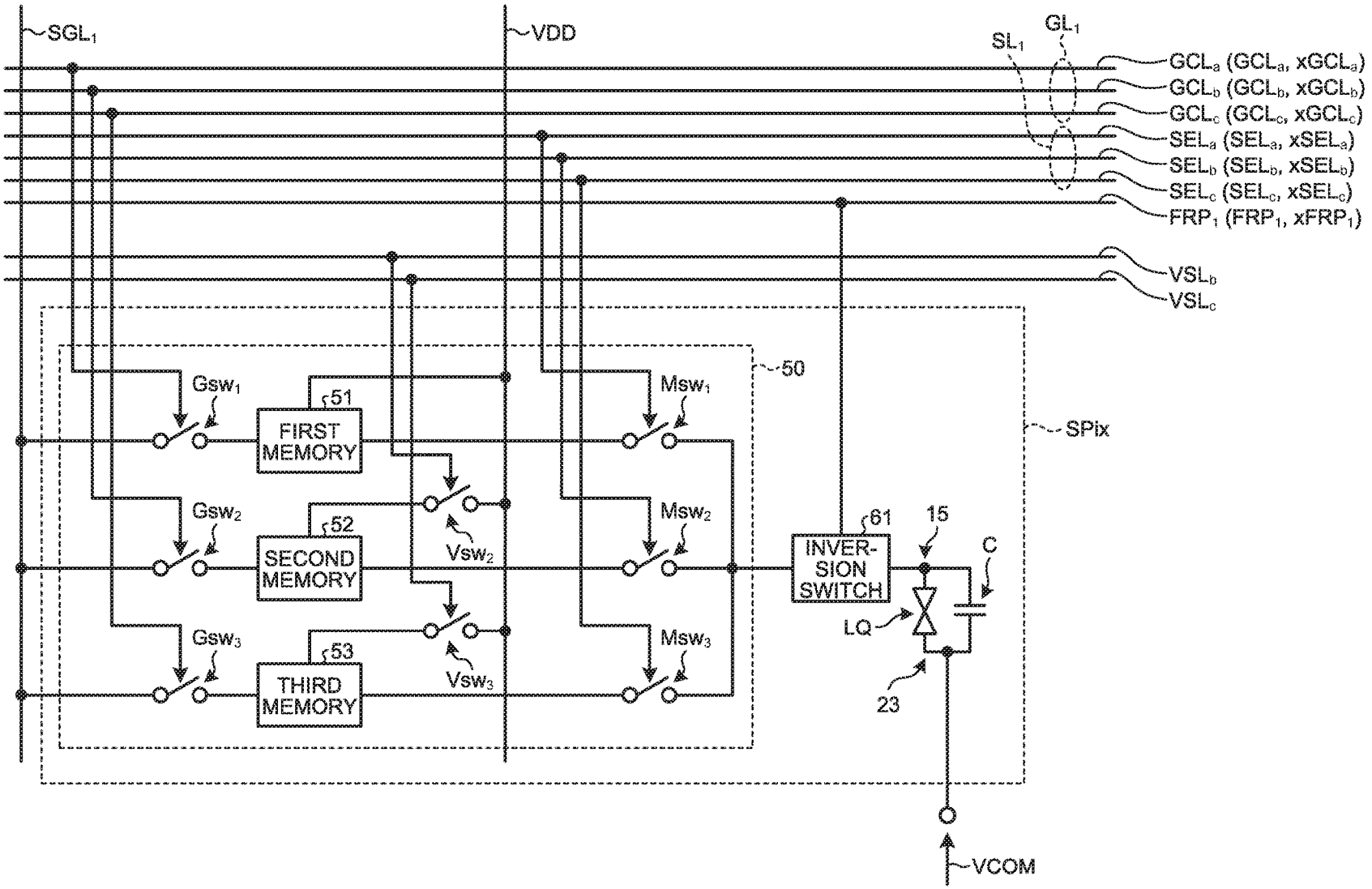
FIG. 11 illustrates a circuit configuration of a sub-pixel of the display device in the modification.

FIG. 10 illustrates a circuit configuration of a display device in a modification. FIG. 11 illustrates a circuit configuration of a sub-pixel SPix of the display device in the modification. In the modification, the first operation signal line $VSL_a$ and the switch $Vsw_1$ in the embodiment are omitted. In the modification, each of the first memories 51 and the high-potential power supply line VDD are coupled to each other without the switch $Vsw_1$ therebetween. For this reason, the supply of electric power to the first memories 51 is kept being on in the modification.

Figure 12:
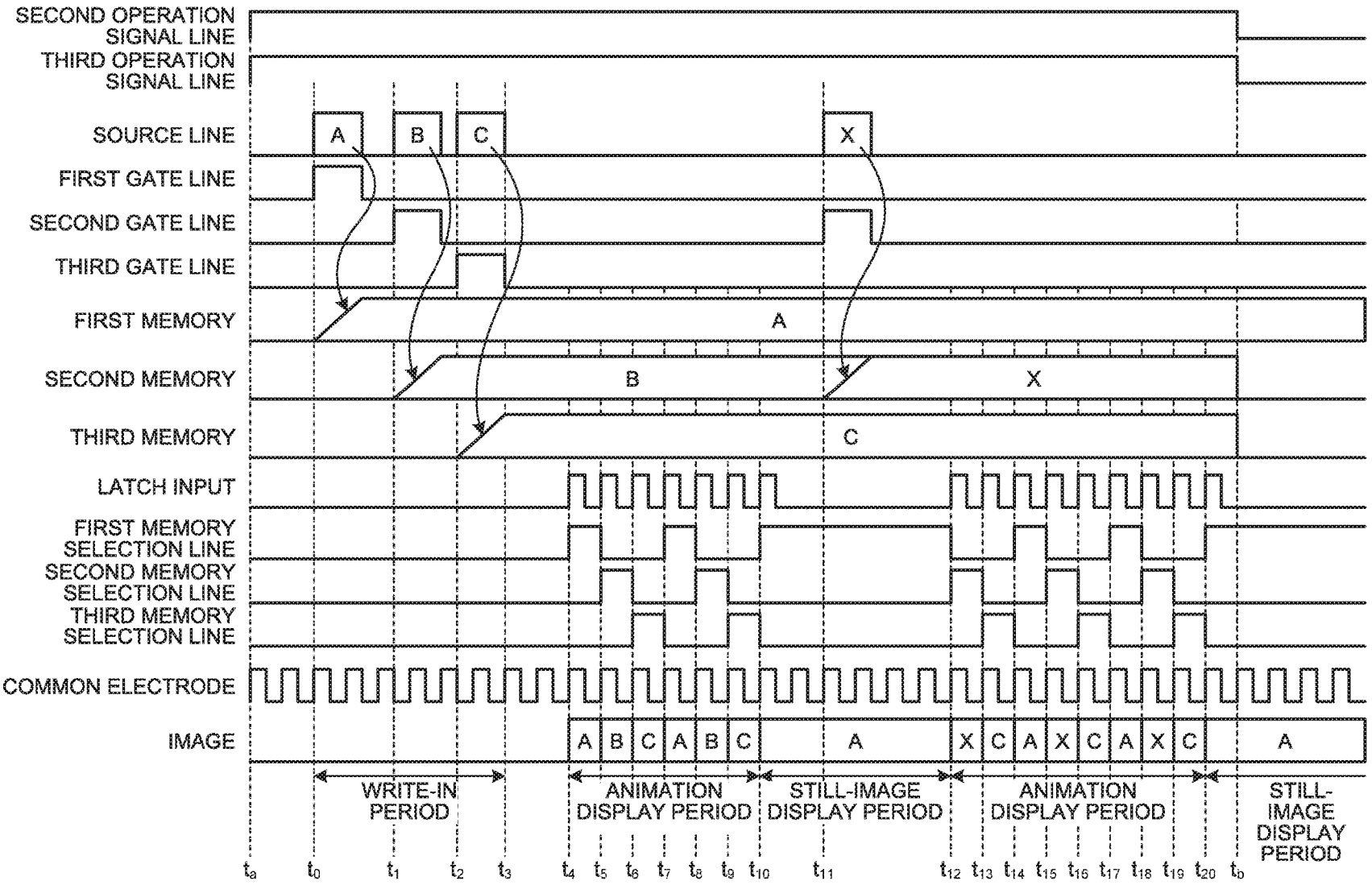
FIG. 12 is a timing chart illustrating operation timings of the display device in the modification.

FIG. 12 is a timing chart illustrating operation timings of the display device in the modification. In the modification, as illustrated in FIG. 12, the display device performs operation that is the same as the operation of the display device described with reference to FIG. 9 except that the supply of an operation signal to the first operation signal line $VSL_a$ is excluded. As described, the modification is the same as the embodiment except for the points particularly noted.

In the modification, the memories (the first memory 51, the second memory 52, and the third memory 53) include at least one memory (the first memory 51) and at least one other memory (the second memory 52 and/or the third memory 53), and the at least one other memory is provided with the conduction switch (the switch $Vsw_2$ and/or the switch $Vsw_3$) on a one-to-one basis. The first memory 51 and the high-potential power supply line VDD are coupled to each other without the switch $Vsw_1$ therebetween. Therefore, the memory for which the conduction switch is provided is limited to at least one memory to which the supply of electric power needs to be turned on and off. Thus, the circuit configuration of each sub-pixel SPix can be further simplified. The first operation signal line $VSL_a$ that transmits an operation signal for causing the switch $Vsw_1$ to operate can be excluded. Thus, wiring of the display device can be further reduced.

While the description made with reference to FIG. 10 to FIG. 12 illustrates the first memory 51 coupled to the high-potential power supply line VDD without the switch $Vsw_1$ therebetween, the second memory 52 coupled to the high-potential power supply line VDD via the switch $Vsw_2$ and the third memory 53 coupled to the high-potential power supply line VDD via the switch $Vsw_3$, this is merely an example. Among the memories in each of the memory blocks, any combination of at least one memory coupled to the high-potential power supply line VDD via a conduction switch and at least one memory coupled to the high-potential power supply line VDD without a conduction switch therebetween may be selected. It is required that both the number of memories coupled to the high-potential power supply line VDD via conduction switches and the number of memories coupled to the high-potential power supply line VDD with no conduction switch therebetween are one or more.

3. Application Example

Figure 13:
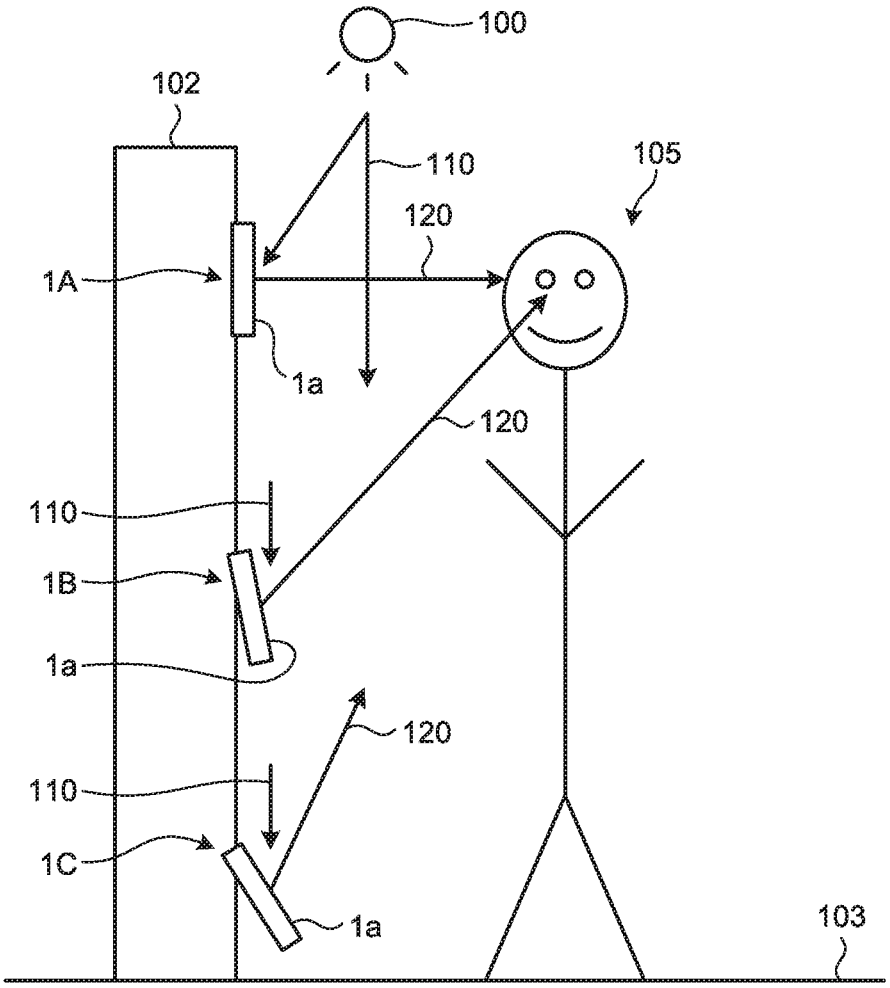
FIG. 13 illustrates an application example of the display device in the embodiment.

FIG. 13 illustrates an application example of the display device in the embodiment. FIG. 13 illustrates an example in which the display device 1 is applied to an electronic shelf label.

As illustrated in FIG. 13, display devices 1A, 1B, and 1C are individually attached to a shelf 102. Each of the display devices 1A, 1B, and 1C has the same configuration as the above described display device 1. The display devices 1A, 1B, and 1C are installed at different heights from a floor surface 103 and with different panel tilt angles. The panel tilt angles are formed by the normal lines of display surfaces 1*a* of the respective display devices and the horizontal direction. The display devices 1A, 1B, and 1C reflects light 110 incident thereon from lighting equipment 100 as a light source, thereby causing images 120 to emanate toward an observer 105.

While preferred embodiments of the present invention have been described heretofore, these embodiments are not intended to limit the present invention. Descriptions disclosed in these embodiments are merely illustrative, and can be modified variously without departing from the spirit of the present invention. For example, while a plurality of sub-pixels SPix of different colors constitute one pixel in the embodiment, a sub-pixel SPix as a single unit, that is, a constituent unit comprising a plurality of memories and one inversion switch, may be deemed as one pixel Pix, for example, when the display region is configured to be monochromatic with white and black. Modifications made without departing from the spirit of the present invention naturally fall within the technical scope of the present invention. At least any of omission, replacement, and modification can be made in various manners to any constituent element in the above described embodiment and each of the modifications without departing from the spirit of the present invention.

What is claimed is:

1. A display device comprising:

a plurality of sub-pixels arranged in a row direction and a column direction and each including a memory block that includes a plurality of memories each of which configured to store therein sub-pixel data;

a plurality of memory selection line groups provided corresponding to a plurality of rows and each including a plurality of memory selection lines electrically coupled to the memory blocks in the sub-pixels that belong to the corresponding row;

a memory selection circuit configured to concurrently output memory selection signals to the memory selection line groups, the memory selection signals each being a signal for selecting one from the memories in the corresponding memory block;

a potential line having a potential for operating the memories applied thereto;

a conduction switch provided for at least one of the memories in the memory block on a one-to-one basis and configured to switch between electrically coupling and electrically uncoupling the potential line and a corresponding one memory; and an operating-memory conduction circuit configured to output, to the conduction switch, an operation signal for determining whether to electrically couple or uncouple the potential line and the corresponding one memory, wherein each of the memories is capable of storing sub-pixel data therein when being coupled to the potential line, and wherein each of the sub-pixels displays an image based on the sub-pixel data stored in one of the memories in the sub-pixel in accordance with the memory selection line that has been supplied with the memory selection signal.

2. The display device according to claim 1, wherein the conduction switch is provided for every memory in each of the memory blocks on a one-to-one basis.

3. The display device according to claim 1, wherein the memories in each of the memory blocks include at least one memory provided with no conduction switches, and at least one other memory provided with the conduction switch on a one-to-one basis, and wherein the at least one memory provided with no conduction switches is coupled to the potential line with no conduction switches therebetween.

4. The display device according to claim 1, further comprising:

an operation signal line configured to transmit the operation signal to the conduction switch provided for one of the memories in each of the corresponding memory blocks.

5. The display device according to claim 1, further comprising:

a plurality of gate line groups provided for respective rows and each including a plurality of gate lines electrically coupled to the memory blocks in the sub-pixels that belong to the corresponding row;

a gate line drive circuit configured to sequentially output a gate signal to the rows in writing the sub-pixel data into the memory blocks, the gate signal being a signal for selecting one of the rows;

a plurality of source lines provided for respective columns;

a source line drive circuit configured to output a plurality of pieces of the sub-pixel data to the source lines in writing the sub-pixel data into the memory blocks; and a gate line selection circuit configured to electrically couple one of the gate lines in each of the gate line groups to the gate line drive circuit in writing the sub-pixel data into the memory blocks, wherein each of the sub-pixels in one of the rows that has the gate signal supplied thereto causes the sub-pixel data supplied to the corresponding source line to be stored in one of the memories therein in accordance with the gate lines that has the gate signal supplied thereto.

6. The display device according to claim 5, wherein, each of the sub-pixels displays an image based on the sub-pixel data stored in a first memory of the sub-pixel, in accordance with the memory selection line that has been supplied with the memory selection signal, and at the same time, the sub-pixel stores the sub-pixel data that has been supplied to the corresponding source line in a second memory of the sub-pixel, in accordance with the gate line that has been supplied with the gate signal, and wherein the first memory is one of the memories of the sub-pixel, and the second memory is one of the memories thereof different from the first memory.

7. The display device according to claim 1, wherein each of the sub-pixels further includes a sub-pixel electrode, and a switch circuit configured to output the sub-pixel data output from the memory block to the sub-pixel electrode, wherein the display device further comprises:

a common electrode to which a common potential common to the sub-pixels is supplied;

a common-electrode drive circuit configured to invert the common potential in synchronization with a reference signal and output the inverted common potential to the common electrode;

a plurality of display signal lines provided for the rows and electrically coupled to the switch circuits; and an inversion drive circuit configured to invert display signals in synchronization with the reference signal and output the inverted display signals to the display signal lines, the display signals being signals for maintaining or inverting the sub-pixel data supplied to the sub-pixel electrodes, and wherein the switch circuits maintain or invert the sub-pixel data based on the display signals and output the sub-pixel data to the sub-pixel electrodes.

8. The display device according to claim 1, wherein the memory selection circuit sequentially switches a destination to which the memory selection signal is to be output, from one to another among memory selection lines in each of the memory selection line groups, the memory selection lines, and wherein, in accordance with the sequential switching of the memory selection lines to which the memory selection signal is to be output, the sub-pixels display a moving image based on the sub-pixel data stored in the memories.

* * * * *